US011762319B2

(12) United States Patent
Kawamura et al.

(10) Patent No.: US 11,762,319 B2
(45) Date of Patent: Sep. 19, 2023

(54) PRINT CONTROL APPARATUS, CONTROL METHOD THEREFOR, STORAGE MEDIUM STORING CONTROL PROGRAM THEREFOR, AND PRINT SYSTEM

(71) Applicant: CANON KABUSHIKI KAISHA, Tokyo (JP)

(72) Inventors: Nobuhiro Kawamura, Chiba (JP); Hiroya Igarashi, Ibaraki (JP); Hirotomo Tanaka, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 8 days.

(21) Appl. No.: 17/544,096

(22) Filed: Dec. 7, 2021

(65) Prior Publication Data

US 2022/0227150 A1 Jul. 21, 2022

(30) Foreign Application Priority Data

Jan. 19, 2021 (JP) ..... 2021-006601

(51) Int. Cl.
*G03G 15/00* (2006.01)
*B41J 29/393* (2006.01)

(52) U.S. Cl.
CPC ..... *G03G 15/5058* (2013.01); *G03G 15/5062* (2013.01); *B41J 2029/3935* (2013.01)

(58) Field of Classification Search
CPC ..... G03G 15/1675; G03G 15/5016; G03G 15/502; G03G 15/5062
See application file for complete search history.

(56) References Cited

U.S. PATENT DOCUMENTS

| | | | | |
|---|---|---|---|---|
| 8,843,003 | B2 | 9/2014 | Nakao | |
| 2017/0097593 | A1* | 4/2017 | Itagaki | G03G 15/1675 |
| 2018/0017904 | A1* | 1/2018 | Aiba | G03G 15/1675 |
| 2019/0107797 | A1* | 4/2019 | Murayama | G03G 15/5062 |
| 2020/0242426 | A1 | 7/2020 | Omata | |
| 2020/0285176 | A1* | 9/2020 | Sueoka | G03G 15/5058 |
| 2020/0409299 | A1* | 12/2020 | Kohno | G03G 15/5054 |

FOREIGN PATENT DOCUMENTS

| | | | |
|---|---|---|---|
| JP | 2013037185 | A | 2/2013 |
| JP | 2020118931 | A | 8/2020 |

* cited by examiner

*Primary Examiner* — Carla J Therrien
(74) *Attorney, Agent, or Firm* — ROSSI, KIMMS & McDOWELL LLP

(57) ABSTRACT

A print control apparatus that improves operability in readjusting a secondary transfer voltage that has been adjusted. The print control apparatus that communicates with an image forming apparatus. The print control apparatus includes an instruction unit that instructs the image forming apparatus to execute a process that prints a predetermined chart, reads the predetermined chart by the reading device, and sets a secondary transfer voltage, a reception unit that receives an adjustment value obtained by the process from the image forming apparatus, and a display control unit that controls a display unit to display an object that prompts a user to adjust at least the secondary transfer voltage based on reception of the adjustment value obtained by the process by the reception unit.

20 Claims, 22 Drawing Sheets

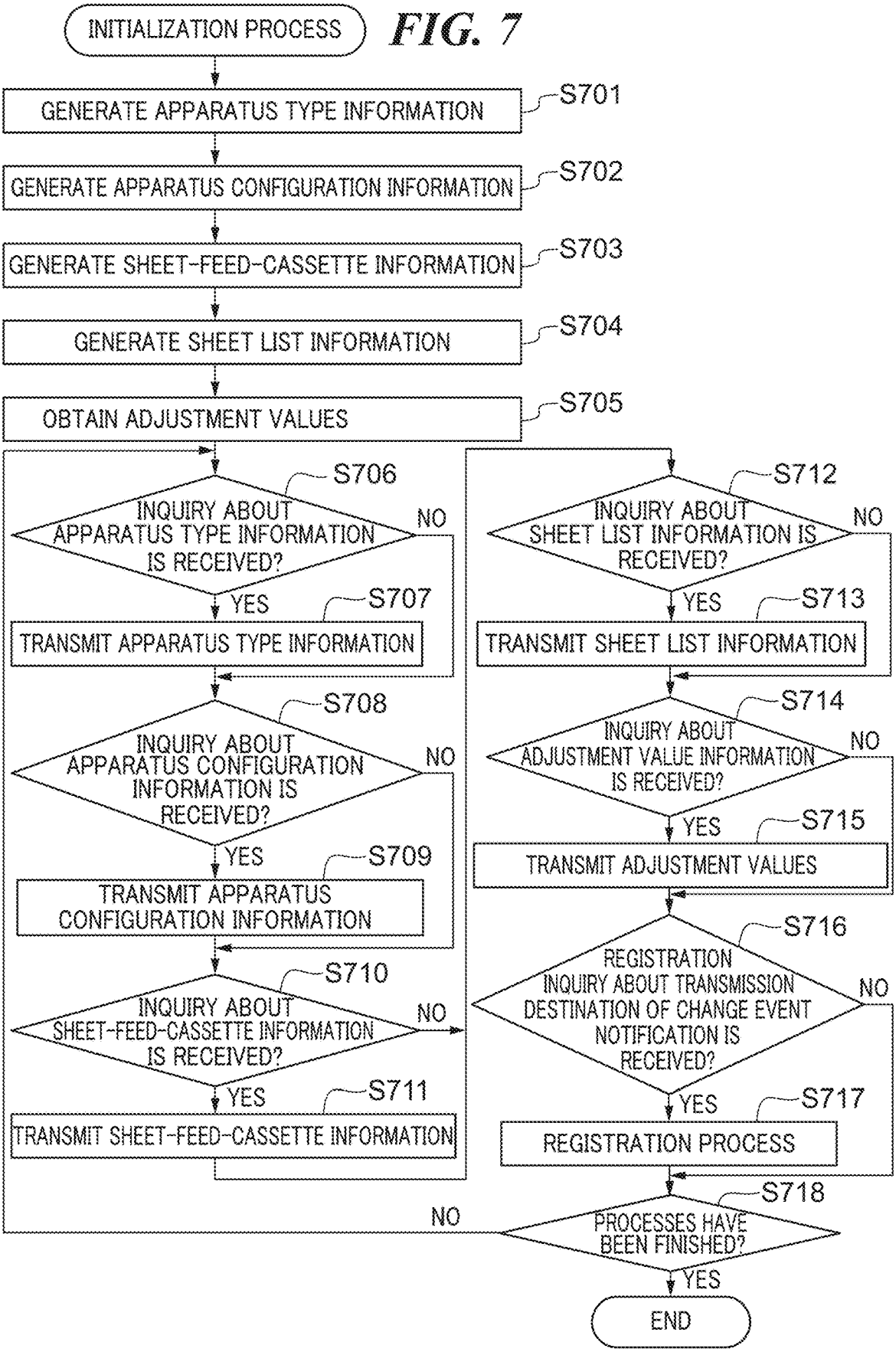
INITIALIZATION PROCESS
FIG. 7
GENERATE APPARATUS TYPE INFORMATION
S701
GENERATE APPARATUS CONFIGURATION INFORMATION
S702
GENERATE SHEET-FEED-CASSETTE INFORMATION
S703
GENERATE SHEET LIST INFORMATION
S704
OBTAIN ADJUSTMENT VALUES
S705
S706
INQUIRY ABOUT APPARATUS TYPE INFORMATION IS RECEIVED?
NO
YES
S707
TRANSMIT APPARATUS TYPE INFORMATION
S708
INQUIRY ABOUT APPARATUS CONFIGURATION INFORMATION IS RECEIVED?
NO
YES
S709
TRANSMIT APPARATUS CONFIGURATION INFORMATION
S710
INQUIRY ABOUT SHEET-FEED-CASSETTE INFORMATION IS RECEIVED?
NO
YES
S711
TRANSMIT SHEET-FEED-CASSETTE INFORMATION
S712
INQUIRY ABOUT SHEET LIST INFORMATION IS RECEIVED?
NO
YES
S713
TRANSMIT SHEET LIST INFORMATION
S714
INQUIRY ABOUT ADJUSTMENT VALUE INFORMATION IS RECEIVED?
NO
YES
S715
TRANSMIT ADJUSTMENT VALUES
S716
REGISTRATION INQUIRY ABOUT TRANSMISSION DESTINATION OF CHANGE EVENT NOTIFICATION IS RECEIVED?
NO
YES
S717
REGISTRATION PROCESS
S718
PROCESSES HAVE BEEN FINISHED?
NO
YES
END

FIG. 8

800

| Sheet ID | Sheet Name | Basis Weight | Size | Width | Height | Surface Nature | Sheet Conveyance Speed of First Fixing Unit | ... | Secondary Transfer Voltage (Front side) | ... |
|---|---|---|---|---|---|---|---|---|---|---|
| 1 | Sheet A | 216 | A4 | 297 | 210 | High-quality Sheet | 0 | ... | 0 | ... |
| 2 | Sheet B | 148 | A4 | 297 | 210 | High-quality Sheet | -1 | ... | 0 | ... |
| 3 | Sheet C | 90 | 11x17 | 279.4 | 431.8 | Recycled Sheet | 0 | ... | 1 | ... |
| 4 | Sheet D | 90 | A3 | 297 | 420 | Mat Coat | -10 | ... | 0 | ... |
| 5 | Sheet E | 350 | A3 | 297 | 420 | Emboss | 0 | ... | 2 | ... |
| ... | ... | ... | ... | ... | ... | ... | ... | ... | ... | ... |

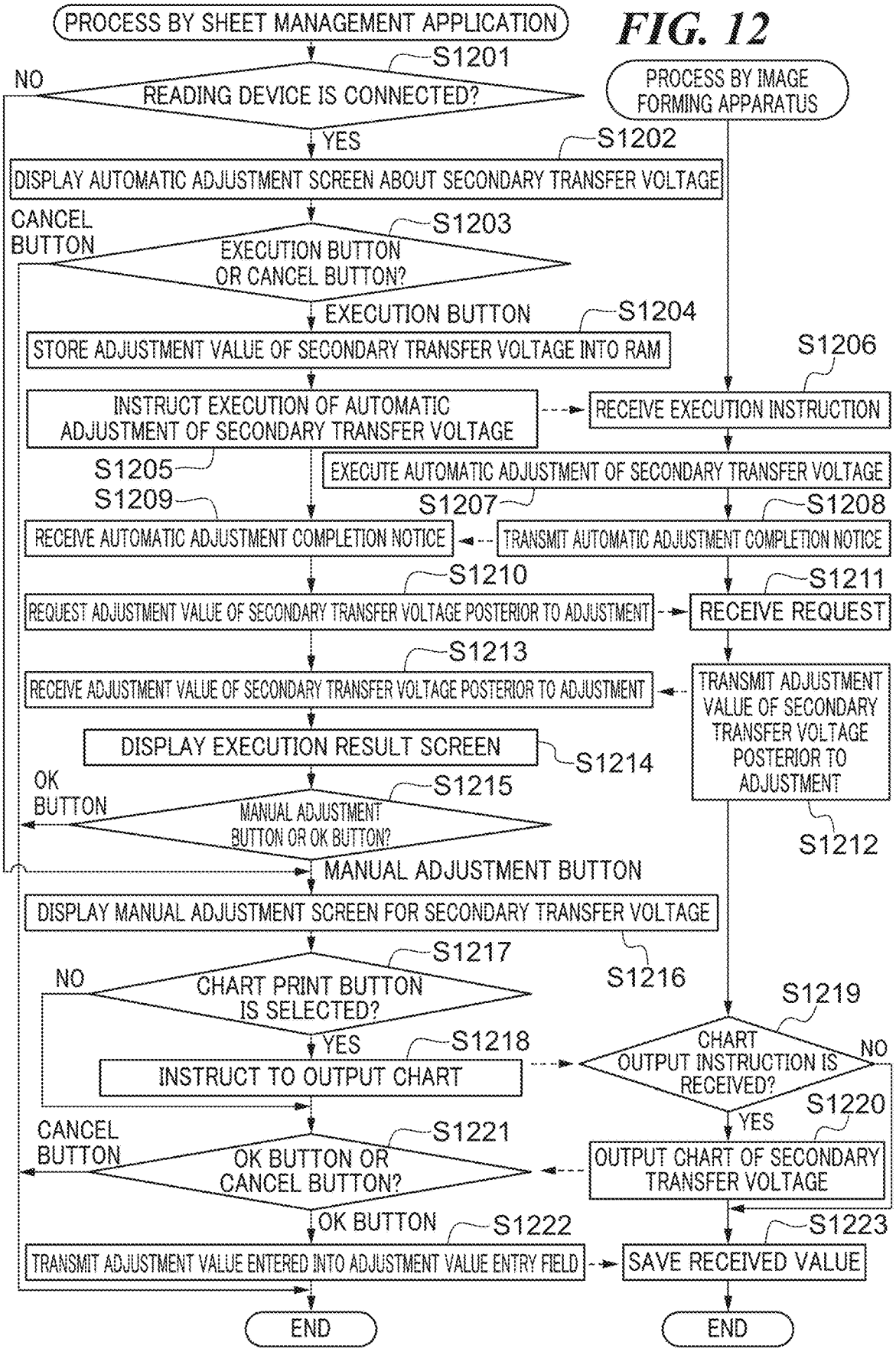
FIG. 12
PROCESS BY SHEET MANAGEMENT APPLICATION
S1201
READING DEVICE IS CONNECTED?
NO
YES
PROCESS BY IMAGE FORMING APPARATUS
S1202
DISPLAY AUTOMATIC ADJUSTMENT SCREEN ABOUT SECONDARY TRANSFER VOLTAGE
CANCEL BUTTON
S1203
EXECUTION BUTTON OR CANCEL BUTTON?
EXECUTION BUTTON
S1204
STORE ADJUSTMENT VALUE OF SECONDARY TRANSFER VOLTAGE INTO RAM
S1206
INSTRUCT EXECUTION OF AUTOMATIC ADJUSTMENT OF SECONDARY TRANSFER VOLTAGE
RECEIVE EXECUTION INSTRUCTION
S1205
EXECUTE AUTOMATIC ADJUSTMENT OF SECONDARY TRANSFER VOLTAGE
S1209
S1207
S1208
RECEIVE AUTOMATIC ADJUSTMENT COMPLETION NOTICE
TRANSMIT AUTOMATIC ADJUSTMENT COMPLETION NOTICE
S1210
S1211
REQUEST ADJUSTMENT VALUE OF SECONDARY TRANSFER VOLTAGE POSTERIOR TO ADJUSTMENT
RECEIVE REQUEST
S1213
RECEIVE ADJUSTMENT VALUE OF SECONDARY TRANSFER VOLTAGE POSTERIOR TO ADJUSTMENT
TRANSMIT ADJUSTMENT VALUE OF SECONDARY TRANSFER VOLTAGE POSTERIOR TO ADJUSTMENT
DISPLAY EXECUTION RESULT SCREEN
S1214
OK BUTTON
S1215
MANUAL ADJUSTMENT BUTTON OR OK BUTTON?
S1212
MANUAL ADJUSTMENT BUTTON
DISPLAY MANUAL ADJUSTMENT SCREEN FOR SECONDARY TRANSFER VOLTAGE
S1216
S1217
NO
CHART PRINT BUTTON IS SELECTED?
S1219
YES
S1218
CHART OUTPUT INSTRUCTION IS RECEIVED?
NO
INSTRUCT TO OUTPUT CHART
S1220
YES
CANCEL BUTTON
S1221
OK BUTTON OR CANCEL BUTTON?
OUTPUT CHART OF SECONDARY TRANSFER VOLTAGE
OK BUTTON
S1222
S1223
TRANSMIT ADJUSTMENT VALUE ENTERED INTO ADJUSTMENT VALUE ENTRY FIELD
SAVE RECEIVED VALUE
END
END

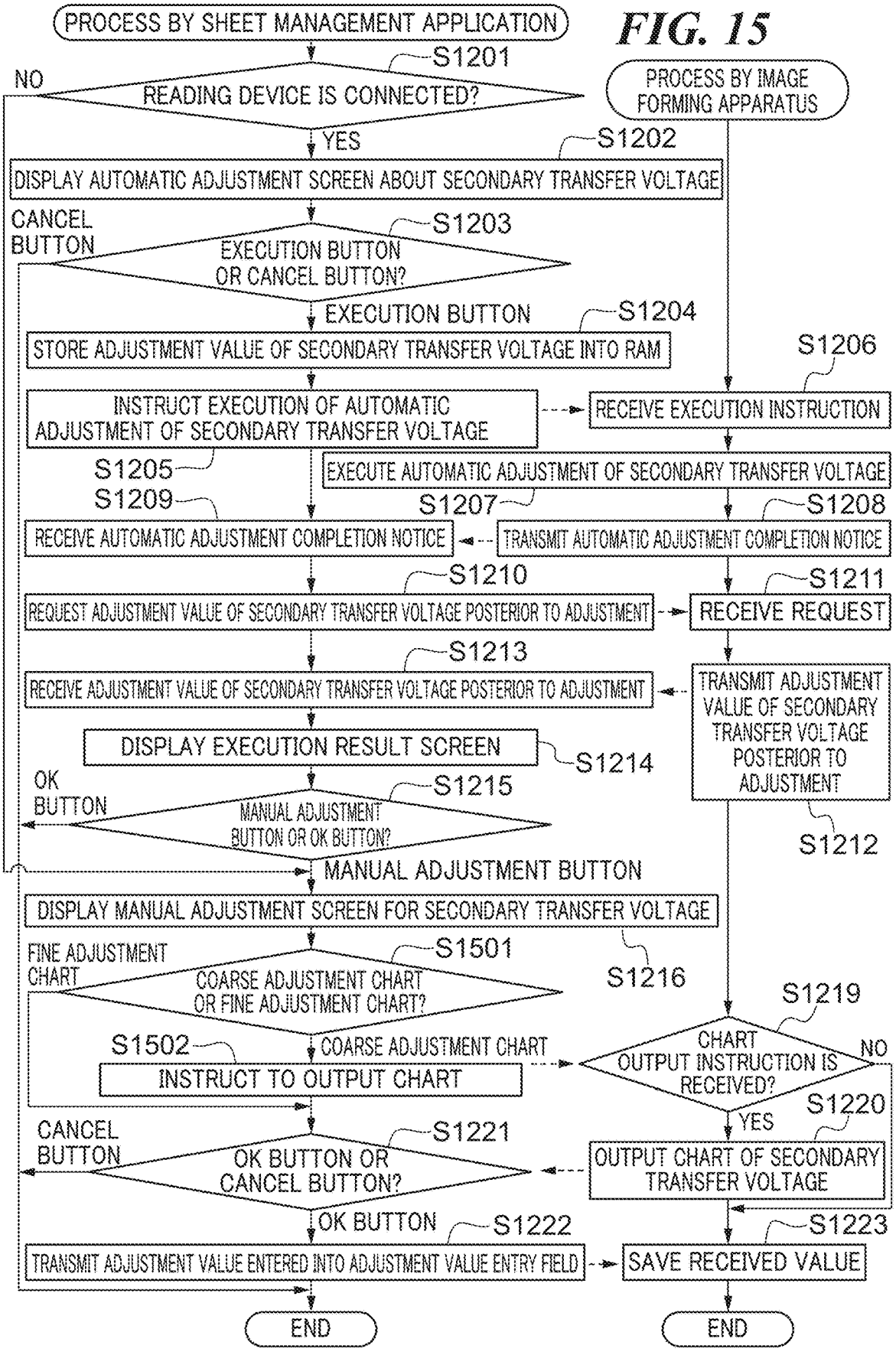
FIG. 15
PROCESS BY SHEET MANAGEMENT APPLICATION
S1201
READING DEVICE IS CONNECTED?
NO
YES
PROCESS BY IMAGE FORMING APPARATUS
S1202
DISPLAY AUTOMATIC ADJUSTMENT SCREEN ABOUT SECONDARY TRANSFER VOLTAGE
CANCEL BUTTON
S1203
EXECUTION BUTTON OR CANCEL BUTTON?
EXECUTION BUTTON
S1204
STORE ADJUSTMENT VALUE OF SECONDARY TRANSFER VOLTAGE INTO RAM
S1206
INSTRUCT EXECUTION OF AUTOMATIC ADJUSTMENT OF SECONDARY TRANSFER VOLTAGE
RECEIVE EXECUTION INSTRUCTION
S1205
EXECUTE AUTOMATIC ADJUSTMENT OF SECONDARY TRANSFER VOLTAGE
S1209
S1207
S1208
RECEIVE AUTOMATIC ADJUSTMENT COMPLETION NOTICE
TRANSMIT AUTOMATIC ADJUSTMENT COMPLETION NOTICE
S1210
S1211
REQUEST ADJUSTMENT VALUE OF SECONDARY TRANSFER VOLTAGE POSTERIOR TO ADJUSTMENT
RECEIVE REQUEST
S1213
RECEIVE ADJUSTMENT VALUE OF SECONDARY TRANSFER VOLTAGE POSTERIOR TO ADJUSTMENT
TRANSMIT ADJUSTMENT VALUE OF SECONDARY TRANSFER VOLTAGE POSTERIOR TO ADJUSTMENT
DISPLAY EXECUTION RESULT SCREEN
S1214
OK BUTTON
S1215
MANUAL ADJUSTMENT BUTTON OR OK BUTTON?
S1212
MANUAL ADJUSTMENT BUTTON
DISPLAY MANUAL ADJUSTMENT SCREEN FOR SECONDARY TRANSFER VOLTAGE
S1216
FINE ADJUSTMENT CHART
S1501
COARSE ADJUSTMENT CHART OR FINE ADJUSTMENT CHART?
S1219
S1502
COARSE ADJUSTMENT CHART
CHART OUTPUT INSTRUCTION IS RECEIVED?
NO
INSTRUCT TO OUTPUT CHART
YES
S1220
CANCEL BUTTON
S1221
OK BUTTON OR CANCEL BUTTON?
OUTPUT CHART OF SECONDARY TRANSFER VOLTAGE
OK BUTTON
S1222
S1223
TRANSMIT ADJUSTMENT VALUE ENTERED INTO ADJUSTMENT VALUE ENTRY FIELD
SAVE RECEIVED VALUE
END
END

PRINT CONTROL APPARATUS, CONTROL METHOD THEREFOR, STORAGE MEDIUM STORING CONTROL PROGRAM THEREFOR, AND PRINT SYSTEM

BACKGROUND OF THE INVENTION

Field of the Invention

The present invention relates to a print control apparatus, a control method therefor, a storage medium storing a control program therefor, and a print system.

Description of the Related Art

Production printing employs an image forming apparatus that can treat various types of sheets, such as thin paper, thick paper, coated paper, and a film. Such an image forming apparatus is provided with a sheet feed unit that consists of a plurality of sheet feed cassettes. Different types of sheets are respectively stored in the different sheet feed cassettes. Sheet information about stored sheets is set to each of the sheet feed cassettes. The sheet information includes attributes, such as a name, a size, and basis weight, of a sheet and adjustment values, such as an adjustment value of a secondary transfer voltage and an adjustment value of an image position, that are optimized for each sheet type.

Since an image forming apparatus used for production printing has many adjustable items, it takes time and effort to set desired adjustment items to optimum values. For example, a user specifies an adjustment item that should be adjusted on the basis of a symptom of an image defect that is appeared in printed matter. Since the user is required to repeat adjustment and test print until the symptom is canceled, a user's workload is extremely large. Japanese Laid-Open Patent Publication (Kokai) No. 2020-118931 (JP 2020-118931A) and Japanese Laid-Open Patent Publication (Kokai) No. 2013-37185 (JP 2013-37185A) propose techniques that reduce a user's workload in an image forming apparatus of an electrophotographic system that forms an image by transferring a toner image onto a sheet while applying voltage to a transfer member.

JP 2020-118931A discloses the technique that forms a plurality of patch images while gradually changing a secondary transfer voltage applied to the transfer member and that sets the optimal secondary transfer voltage by a user by checking transfer properties of these patch images. Although the technique can reduce the user's workload because the repeat of the adjustment and test print becomes unnecessary, the time and effort of a user to visually check a plurality of printed patch images remain.

As compared with this, JP 2013-37185A discloses the technique that automatically sets the optimal secondary transfer voltage by detecting a plurality of patch images formed on a sheet with a density sensor. When this technique is used, not only the repeat of the adjustment and test print becomes unnecessary, but also the visual check of the patch images by a user becomes unnecessary. As a result, a user's workload can be further reduced.

However, the method that detects the patch images with the density sensor may not set the optimal secondary transfer voltage that a user desires. In such a case, the user is required to readjust the secondary transfer voltage by visually checking the patch images. Moreover, since this conventional technique respectively requires a plurality of operations in a case of displaying information about an adjustment value of the secondary transfer voltage to determine necessity of the readjustment of the secondary transfer voltage and in a case of displaying a setting screen for readjusting the secondary transfer voltage, the operability is extremely bad.

SUMMARY OF THE INVENTION

The present invention provides a mechanism that improves operability in readjusting a secondary transfer voltage that has been adjusted.

Accordingly, an aspect of the present invention provides a print control apparatus that communicates with an image forming apparatus. The print control apparatus includes an instruction unit configured to instruct the image forming apparatus to execute a process that prints a predetermined chart, reads the predetermined chart by the reading device, and sets a secondary transfer voltage, a reception unit configured to receive an adjustment value obtained by the process from the image forming apparatus, and a display control unit configured to control a display unit to display an object that prompts a user to adjust at least the secondary transfer voltage based on reception of the adjustment value obtained by the process by the reception unit.

According to the present invention, the operability in readjusting the secondary transfer voltage that has been adjusted is improvable.

Further features of the present invention will become apparent from the following description of exemplary embodiments with reference to the attached drawings.

BRIEF DESCRIPTION OF THE DRAWINGS

FIG. 7 is a flowchart showing procedures of an initialization process executed by the image forming apparatus in FIG. 1.

FIG. 8 is a view showing an example of the sheet setting management table managed by a sheet management application in FIG. 4B.

FIG. 12 is a flowchart showing procedures of a secondary-transfer-voltage adjustment process executed by the print system in FIG. 1.

FIG. 15 is a flowchart showing procedures of a modified example of the secondary-transfer-voltage adjustment process executed by the print system in FIG. 1.

DESCRIPTION OF THE EMBODIMENTS

Figure 1:
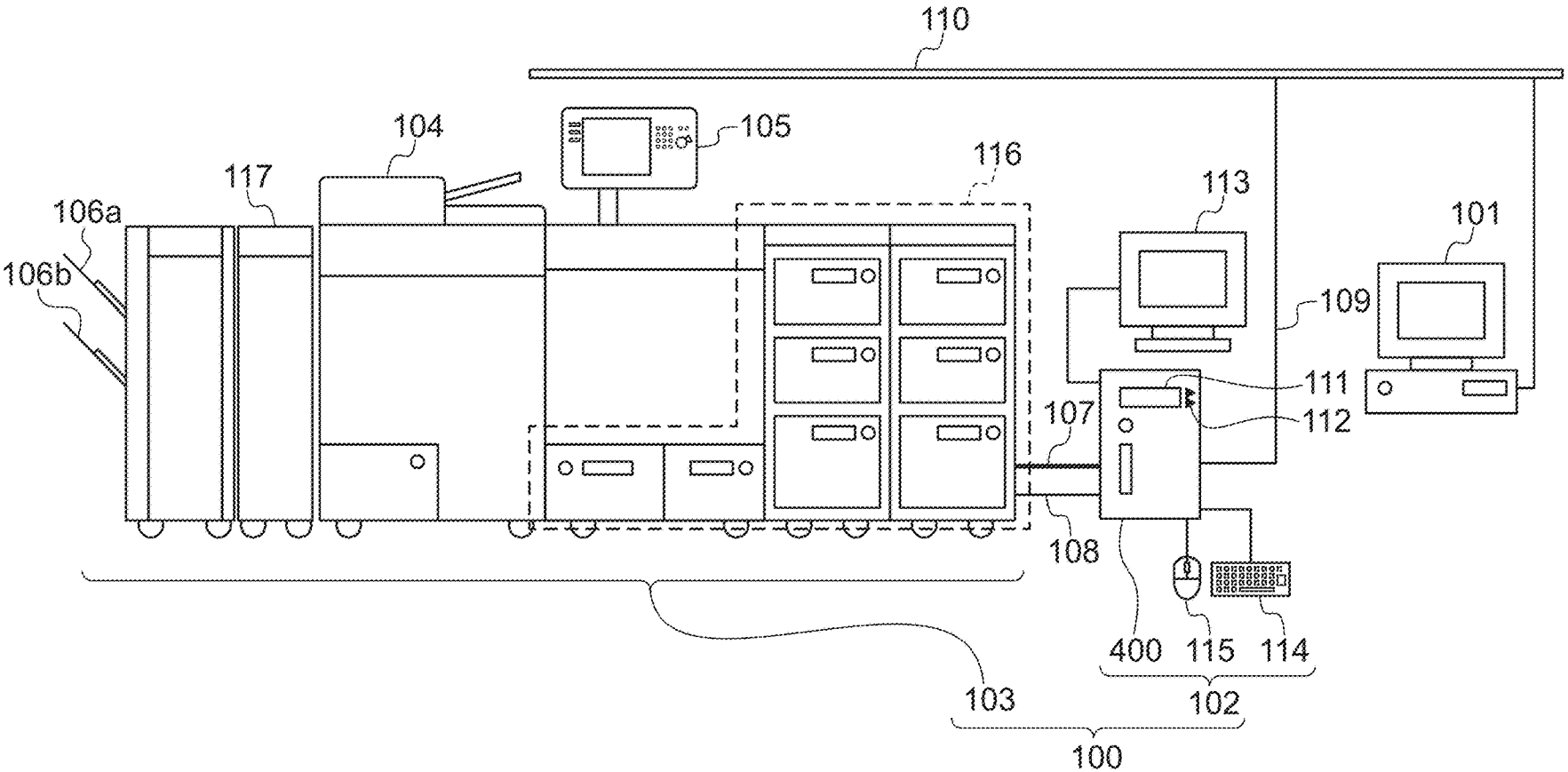
FIG. 1 is a configuration diagram schematically showing a configuration of a print system equipped with a print control apparatus according to an embodiment of the present invention.

Hereafter, embodiments according to the present invention will be described in detail by referring to the drawings.

FIG. 1 is a configuration diagram schematically showing a configuration of a print system 100 equipped with a print control apparatus 102 according to an embodiment of the present invention.

As shown in FIG. 1, the print system 100 is provided with the print control apparatus 102 and an image forming apparatus 103. The print control apparatus 102 is connected with the image forming apparatus 103 through an image video cable 107 and a control cable 108. Moreover, the print control apparatus 102 is connected to a LAN (Local Area Network) 110 through an Ethernet cable 109 and communicates with a client computer 101 through the LAN 110. The image forming apparatus 103 is not connected to the LAN 110 but communicates with the client computer 101 through the print control apparatus 102. Although the configuration in which the image forming apparatus 103 is not connected to the LAN 110 is described in the embodiment, the present invention is not restricted to this configuration. For example, the image forming apparatus 103 may be connected to the LAN 110 and communicate with the client computer 101 through the LAN 110.

The client computer 101 issues a print designation etc. to the print system 100 by starting an application installed in the client computer 101. The print control apparatus 102 is provided with a controller 400 and a display unit 111. The print control apparatus 102 cooperates with the image forming apparatus 103 to perform an image process. A user selects and switches information currently displayed on the display unit 111 by operating hardware operation buttons 112 of the print control apparatus 102. Since the display area of the display module 111 is relatively narrow, the display module 111 displays minimum necessary information, such as information for operating ON/OFF of the power of the print control apparatus 102 and an IP address of the print control apparatus 102. Moreover, an external display device 113, a keyboard 114, and a pointing device 115 are connected to the print control apparatus 102. It should be noted that the external display device 113 may be provided with a touch position detection function like a touchpad to additionally hold the function of the pointing device 115 in the embodiment. Moreover, the print control apparatus 102 designates execution of automatic adjustment of a secondary transfer voltage mentioned later to the image forming apparatus 103 according to an instruction received from a user.

The image forming apparatus 103 is a multifunction apparatus having a plurality of functions and is provided with a scanner unit 104, an operation panel 105, a discharge tray 106*a*, a discharge tray 106*b*, a sheet feed unit 116, and a reading device 117. The image forming apparatus 103 not only performs image processing of data received from the client computer 101 or the print control apparatus 102, but also copies data read by the scanner unit 104 and transmits the data concerned to a shared folder. A user operates the operation panel 105 to designate the scanner unit 104 to read a document, for example. Various kinds of information, such as a scanning state, are displayed on the operation panel 105. A sheet to which an image has been formed is discharged to the discharge tray 106*a* or the discharge tray 106*b*. The sheet feed unit 116 consists of a plurality of sheet feed cassettes that store sheets used to print. Sheets that are different in size and type are respectively stored in the different sheet feed cassettes. When receiving a print instruction, the image forming apparatus 103 selects one sheet feed cassette from among the plurality of sheet feed cassettes, feeds a sheet from the selected sheet feed cassette, and prints an image on the sheet concerned. It should be noted that the number of the sheet feed cassettes that constitute the sheet feed unit 116 depends on an option configuration of the image forming apparatus 103. Moreover, the configuration of the sheet feed unit 116 is not restricted to the above-mentioned configuration but may also include other mechanisms, such as an inserter and a manual feed tray. The reading device 117 is provided with a sensor that reads a chart printed for various adjustments, such as adjustment of a position of a printed image on a sheet, correction of density unevenness, and adjustment of a secondary transfer voltage.

Figure 2:
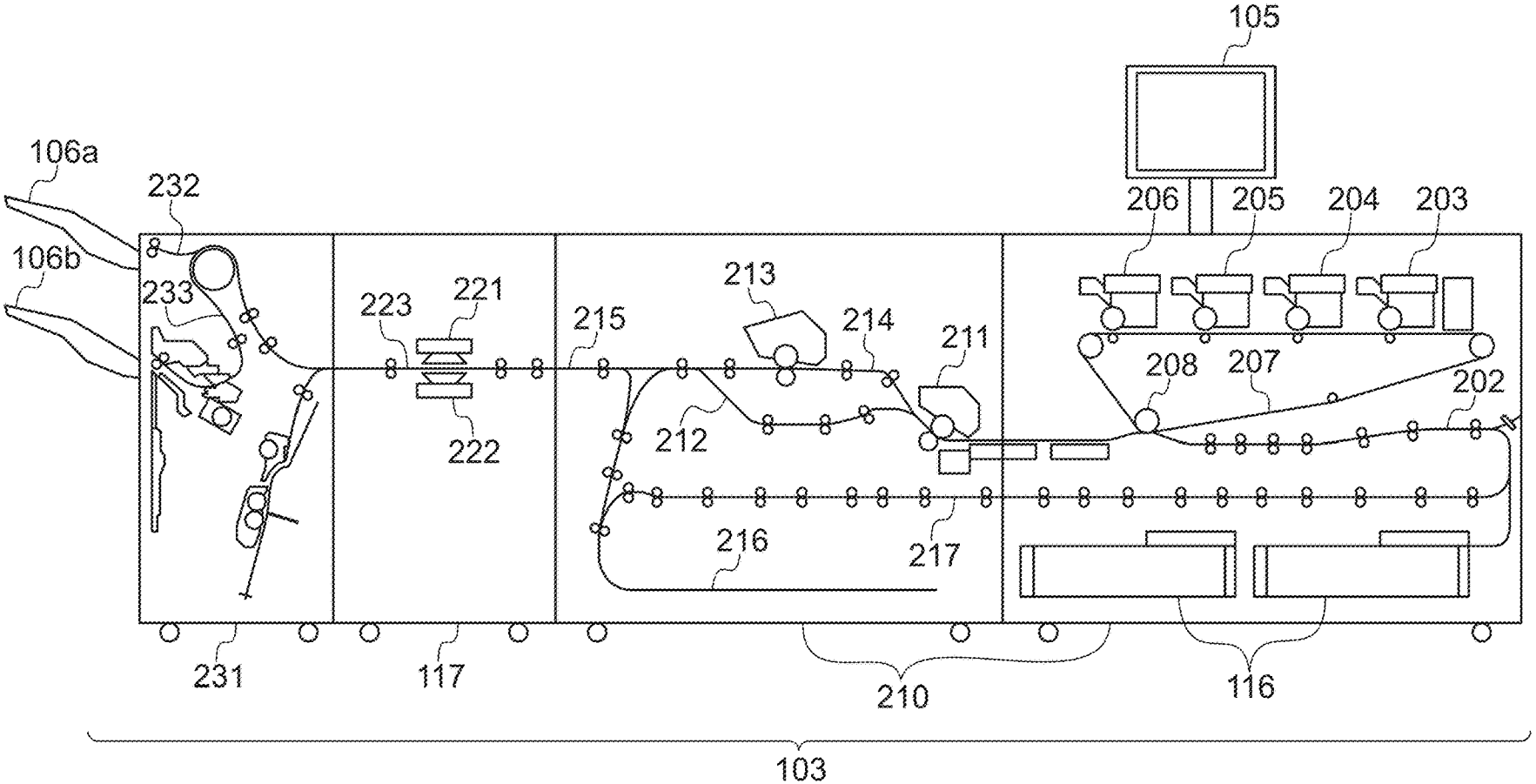
FIG. 2 is a side view of an image forming apparatus in FIG. 1.

FIG. 2 is a side view of the image forming apparatus 103 in FIG. 1. It should be noted that FIG. 2 shows an internal configuration in a transparent state in order to understand easily and omits a part of the sheet feed unit 116.

As shown in FIG. 2, the print engine 210 is provided with the sheet feed unit 116, development stations 203, 204, 205, and 206, an intermediate transfer belt 207, a secondary transfer roller 208, a first fixing unit 211, and a second fixing unit 213. In the sheet feed unit 116, an uppermost sheet of a sheet bundle stored in the selected sheet feed cassette is separated from the sheet bundle and is conveyed to a sheet conveyance path 202. The development stations 203 through 206 respectively form toner images using the color toners of Y (yellow), M (magenta), C (cyan), and K (black). The formed toner images are first primarily transferred to the intermediate transfer belt 207 so as to overlap to form a full color toner image. The intermediate transfer belt 207 rotates clockwise in FIG. 2, and the full color toner image is transferred to the sheet conveyed from the sheet conveyance path 202 with the secondary transfer roller 208. The sheet to which the toner image is transferred is conveyed to the first fixing unit 211.

The first fixing unit 211 is provided with a pressure roller and a heating roller and fixes the toner image to the sheet by melting and press-fitting the toner while passing the sheet between the rollers. The sheet that passed the first fixing unit 211 passes along the sheet conveyance path 212 and is conveyed to a sheet conveyance path 215. In the meantime, when a sheet type of a used sheet needs additional melting and press-fitting for fixing, the sheet that has passed the first fixing unit 211 is conveyed to the second fixing unit 213 through a sheet conveyance path 214. The sheet to which the additional melting and press-fitting are applied with the second fixing unit 213 is conveyed to the sheet conveyance path 215. When a print mode is set to both-sided printing, the print engine 210 conveys the sheet that has passed the first fixing unit 211 or the second fixing unit 213 to a sheet inversion path 216 to invert the surfaces of the sheet concerned. After that, this sheet is conveyed to the secondary transfer roller 208 through a both-sided conveyance path 217. At the secondary transfer roller 208, a toner image is transferred to the surface that is different from the surface to which the toner image has been already transferred of the conveyed sheet. For example, the toner image is transferred to the back surface.

The sheet conveyed from the print engine 210 is conveyed to the reading device 117. In the reading device 117, a first CIS (Contact Image Sensor) 221 and second CIS 222 are arranged at an upper position and a lower position, respectively. Although the CISs are employed in the embodiment, sensors are not limited to CISs. Other sensors may be employed as long as the sensors are able to read a patch and a marker on a sheet. The first CIS 221 reads an upper side of a sheet and the second CIS 222 reads a lower side of a sheet. The reading device 117 reads patches on a sheet using the first CIS 221 and second CIS 222 at timing at which the sheet conveyed to the sheet conveyance path 223 arrives at the predetermined position. Moreover, the reading device 117 feeds back the read result as image position information, density information, etc. to the print engine 210. The sheet read with the first CIS 221 and second CIS 222 is conveyed to a finisher 231.

The finisher 231 performs finishing processes, such as a staple process, a punch process, and a saddle stitch bookbinding process, to the sheet conveyed from the reading device 117. The finisher 231 is provided with a discharge tray 106*a* and a discharge tray 106*b*. The finisher 231 discharges a sheet to which the finishing process is applied to the discharge tray 106*a* through a sheet conveyance path 232 or discharges a sheet to the discharge tray 106*b* through a sheet conveyance path 233.

Figure 3:
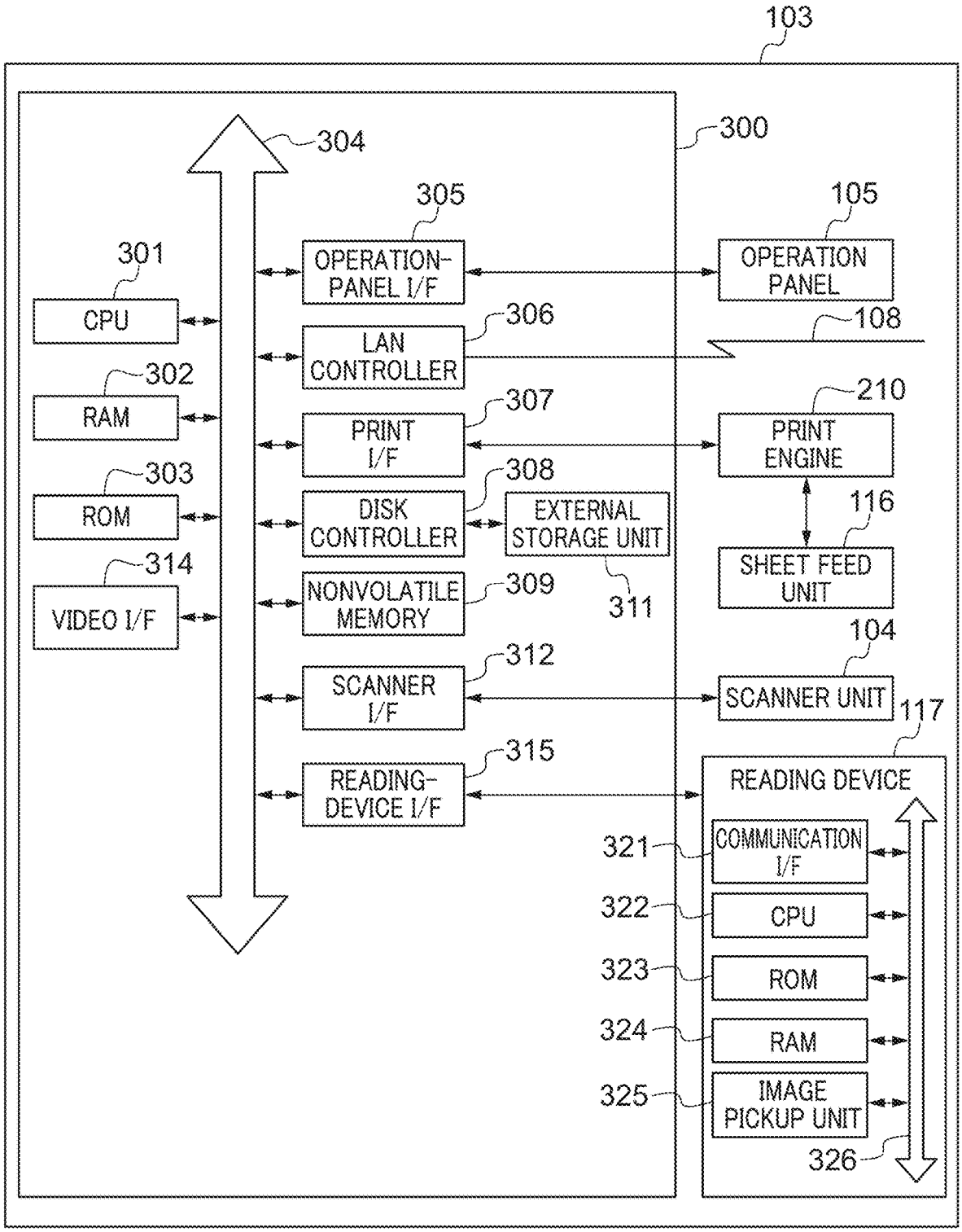
FIG. 3 is a block diagram schematically showing a configuration of the image forming apparatus in FIG. 1.

FIG. 3 is a block diagram schematically showing a configuration of the image forming apparatus 103 in FIG. 1 having a controller 300. As shown in FIG. 3, the controller 300 is provided with a CPU 301, a RAM 302, a ROM 303, an operation-panel I/F 305, a LAN controller 306, a print I/F 307, a disk controller 308, and a nonvolatile memory 309. Moreover, the controller 300 is provided with an external storage unit 311, a scanner I/F 312, a video I/F 314, and a reading-device I/F 315. These are mutually connected through a system bus 304.

The CPU 301 develops control programs stored in the ROM 303 and external storage unit 311 onto the RAM 302, runs the developed programs, and totally controls components connected to the system bus 304. For example, the CPU 301 outputs an image signal to the print engine 210 connected through the print I/F 307 and receives an image signal from the scanner unit 104 connected through the scanner I/F 312. Moreover, the CPU 301 controls the sheet feed unit 116 connected to the print engine 210 through the print I/F 307 and obtains a state of the sheet feed unit 116. Furthermore, the CPU 301 communicates with the print control apparatus 102 through the LAN controller 306 and control cable 108. The RAM 302 functions as a main memory, a work area, etc. of the CPU 301. The external storage unit 311 is an HDD, an IC card, etc. The disk controller 308 controls access to the external storage unit 311. The external storage unit 311 stores application programs, font data, form data, etc. Moreover, the external storage unit 311 is used as a job storage area that spools a print job temporarily and enables control of the spooled job from the outside. Furthermore, the external storage unit 311 is used as a BOX data storage area that holds image data obtained from the scanner unit 104 and image data of a print job as BOX data. The image data held as the BOX data can be referred from the network and can be printed. Moreover, the external storage unit 311 holds various logs, such as a job log and an image log.

The operation panel 105 is connected to the controller 300 through the operation panel I/F 305. A user is able to input various information by operating software keys displayed on the operation panel 105 and hardware keys arranged on the operation panel 105. The nonvolatile memory 309 stores information about various settings set up from the operation panel 105 or an external apparatus. The video I/F 314 receives image data from the print control apparatus 102. The reading-device I/F 315 obtains information about a patch that the reading device 117 reads and density information from the reading device 117.

The reading device 117 is provided with a communication I/F 321, a CPU 322, a ROM 323, a RAM 324, and an image pickup unit 325. These components are mutually connected through a system bus 326. The reading device 117 transmits reading control of a patch and a marker, a read patch, and density information to the controller 300.

Figure 4A:
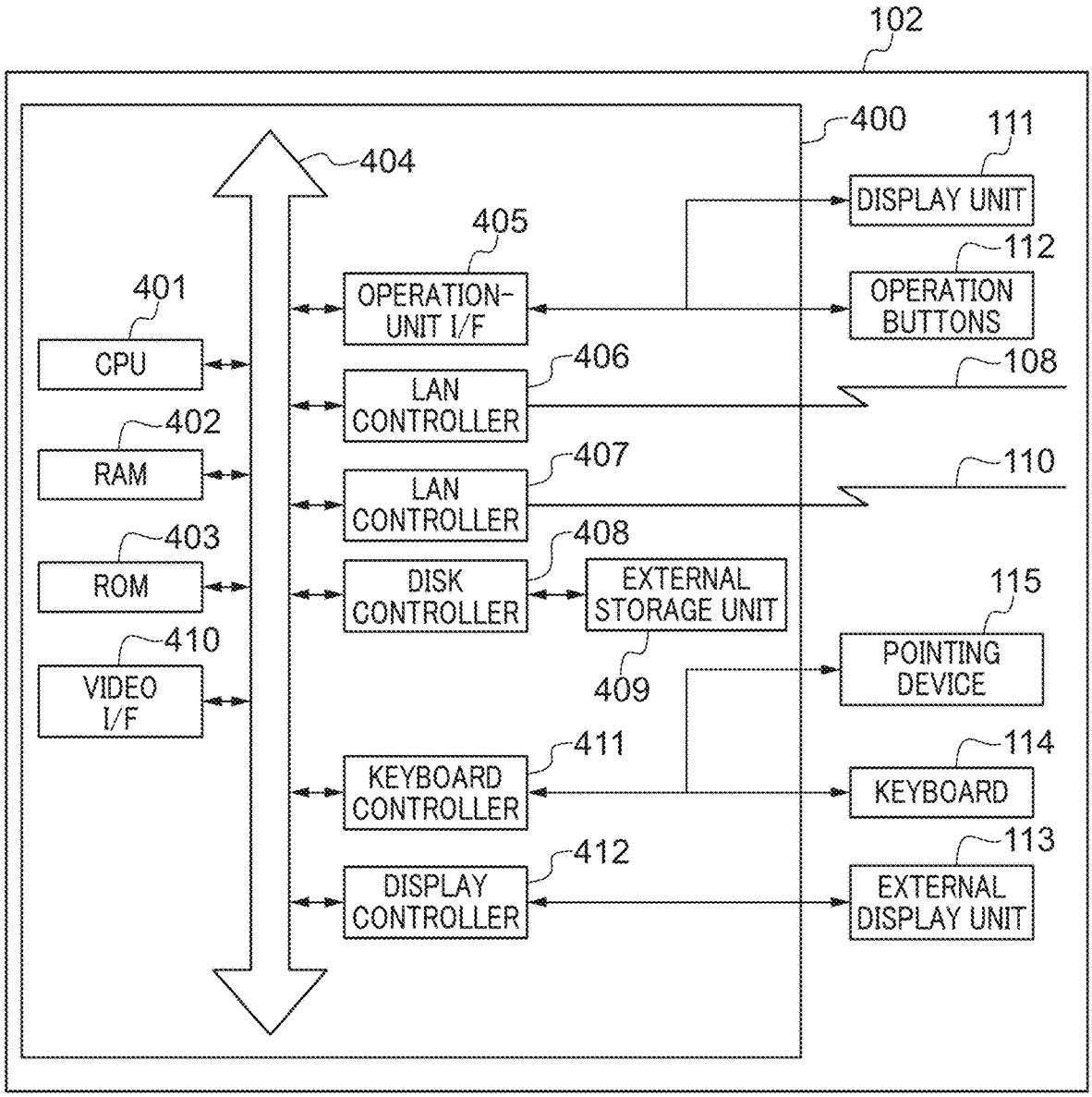
FIG. 4A and FIG. 4B are block diagrams describing a configuration of the print control apparatus in FIG. 1.
Figure 4B:
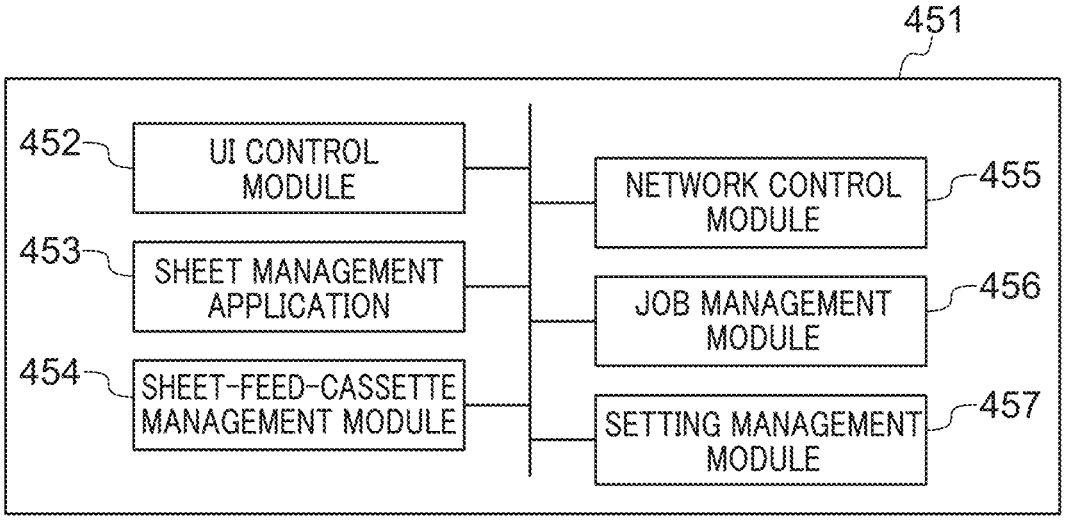

FIG. 4A and FIG. 4B are block diagrams describing a configuration of the print control apparatus 102 in FIG. 1. FIG. 4A is a block diagram schematically showing a configuration of the print control apparatus 102 having a controller 400. As shown in FIG. 4A, the controller 400 is provided with a CPU 401, a RAM 402, a ROM 403, an operation I/F 405, a LAN controller 406, a LAN controller 407, a disk controller 408, and an external storage unit 409. Moreover, the controller 400 is provided with a video I/F 410, a keyboard controller 411, and a display controller 412. These are mutually connected through a system bus 404.

The CPU 401 develops control programs stored in the ROM 403 and external storage unit 409 onto the RAM 402, runs the developed programs, and totally controls components connected to the system bus 404. Moreover, the CPU 401 communicates with the image forming apparatus 103 through the LAN controller 406 and control cable 108. Furthermore, the CPU 401 communicates with the client computer 101 etc. on the network through the LAN controller 407 and LAN 110. The RAM 402 functions as a main memory, a work area, etc. of the CPU 401. The external storage unit 409 is a nonvolatile storage device, such as an HDD, an IC card, or the like. The disk controller 408 controls access to the external storage unit 409.

The external storage unit 409 stores application programs, font data, form data, etc. Moreover, the external storage unit 409 is used as a job storage area that spools a print job temporarily and stores a print job that is obtained by applying a RIP (Raster Image Processor) process to the spooled job. The operation I/F 405 exchanges data with the operation buttons 112 and display unit 111. The video I/F 410 transmits image data to which the RIP process is applied, to the image forming apparatus 103. The keyboard controller 411 exchanges data with the keyboard 114 and pointing device 115. The display controller 412 is provided with a video memory, draws image data to the video memory according to an instruction received from the CPU 401, and outputs the image data drawn in the video memory to the external display device 113 as a video signal.

FIG. 4B is a block diagram schematically showing a configuration of a software module 451 that controls the print control apparatus 102. As shown in FIG. 4B, the software module 451 includes a UI control module 452, a sheet management application 453, sheet-feed-cassette management module 454, network control module 455, job management module 456, and setting management module 457. The processes by these modules are achieved because the CPU 401 runs programs that are developed to the RAM 402.

The UI control module 452 controls displays of the display unit 111 and the external display device 113. The UI control module 452 can switch a text and a display unit system of a sheet size that are displayed on a screen according to a setting of the system. The sheet management application 453 obtains the sheet information about the sheets stored in the sheet feed unit 116 from the image forming apparatus 103 and manages the sheet information with a sheet setting management table 800 shown in FIG. 8 mentioned later. The sheet information includes attributes, such as a name, a size, and basis weight, of a sheet and adjustment values, such as an adjustment value of a secondary transfer voltage and an adjustment value of an image position, that are optimized for each sheet type. The sheet-feed-cassette management module 454 obtains the sheet-feed-cassette information that shows the configuration of the sheet feed unit 116 from the image forming apparatus 103 and manages the obtained sheet-feed-cassette information.

The network control module 455 controls communication with the image forming apparatus 103 through the LAN controller 406 and communication with the client computer 101 on the network through the LAN controller 407. The job management module 456 manages an execution order of print process sequences and jobs. The job management module 456 manages a job received by the print control apparatus 102 and controls data transfer for printing the received job. For example, the job management module 456 controls so as to transfer the received job to the image forming apparatus 103 through the LAN controller 406 or the video interface 410. The setting management module 457 manages the settings about the sheet management. The settings about the sheet management include a setting of a text displayed on the screen about the sheet management, a setting of the display unit system (millimeter or inch) of a sheet size, for example.

Figure 5:
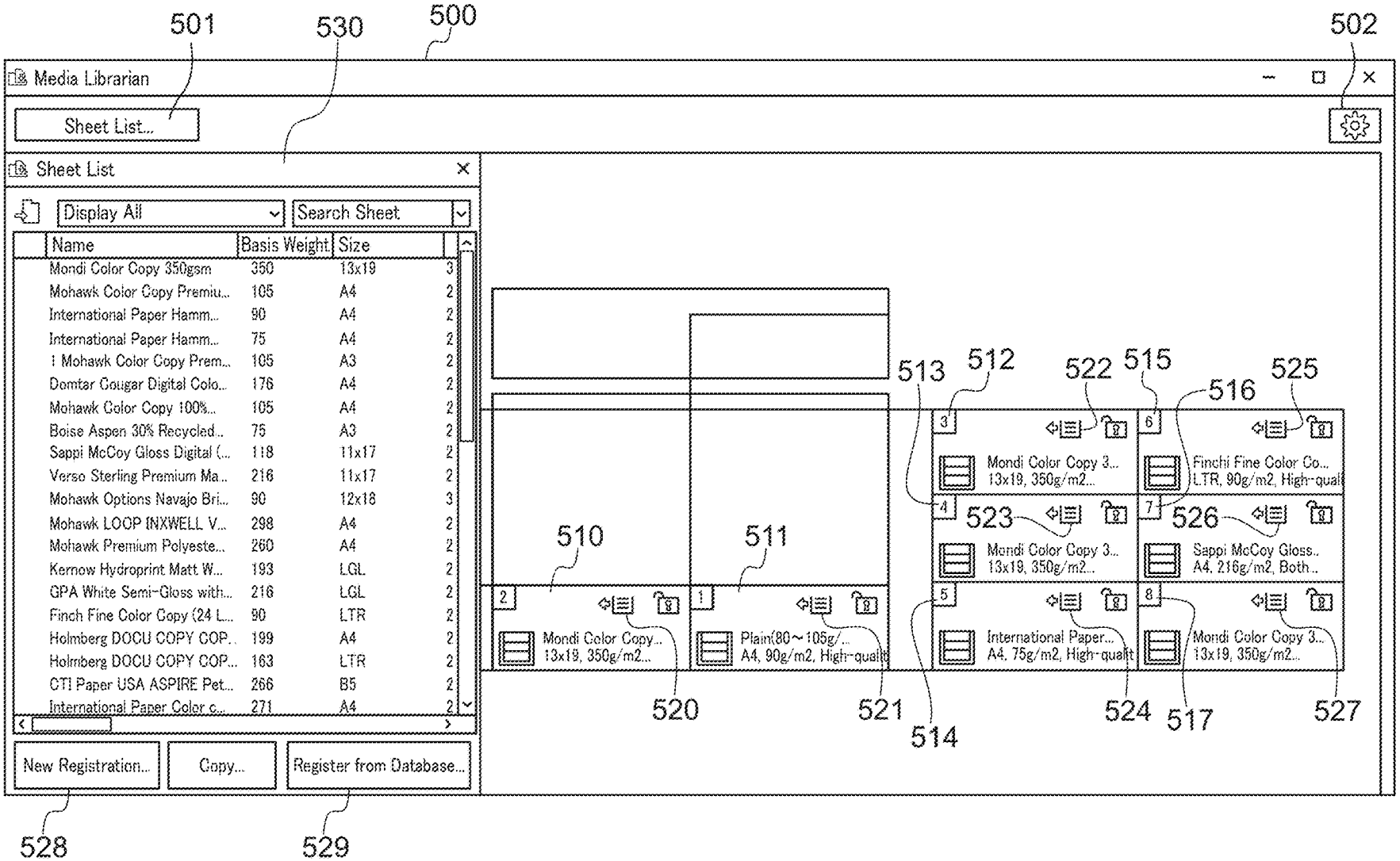
FIG. 5 is a view showing an example of a top screen displayed on an external display device of the print control apparatus in FIG. 1.

FIG. 5 is a view showing an example of a top screen 500 displayed on the external display device 113 of the print control apparatus 102 in FIG. 1. The external display device 113 displays the top screen 500 based on the video signal received from the display controller 412. Specifically, the video signal corresponds to the image data of the top screen 500 drawn in the video memory of the display controller 412. The information about the sheet feed unit 116 of the image forming apparatus 103 connected to the print control apparatus 102 is displayed on the top screen 500.

When the sheet management application 453 starts, the controller 400 obtains apparatus configuration information mentioned later from the image forming apparatus 103 connected to the print control apparatus 102 and displays the top screen 500 on the external display device 113 on the basis of the apparatus configuration information. In FIG. 5, the information about the sheet feed unit 116 that consists of eight sheet feed cassettes is displayed. Sheet-feed-cassette buttons 510, 511, 512, 513, 514, 515, 516, and 517 correspond to the respective sheet feed cassettes. For example, when a user selects the sheet-feed-cassette button 510 by operating the pointing device 115, a sheet-feed-cassette screen 900 in FIG. 9 mentioned later concerning the sheet feed cassette corresponding to the sheet-feed-cassette button 510 is displayed on the external display device 113. The attributes, such as a type, size, basis weight, and remaining amount, about the sheets stored in a sheet feed cassette are displayed on a corresponding one of the sheet-feed-cassette button 510 through 517. When receiving a change event notification from the image forming apparatus 103, the controller 400 obtains sheet-feed-cassette information mentioned later from the image forming apparatus 103. The change event notification shows that the sheet-feed-cassette information is changed because the state of a sheet feed cassette of the sheet feed unit 116 varies. The controller 400 displays the attributes of which contents are updated on the basis of the obtained sheet-feed-cassette information on the sheet-feed-cassette buttons 510 through 517.

Sheet-feed-cassette open buttons 520, 521, 522, 523, 524, 525, 526, and 527 are used to instruct the corresponding sheet feed cassettes to open. For example, when a user selects the sheet-feed-cassette open button 520, the sheet feed cassette corresponding to the sheet-feed-cassette open button 520 opens. A sheet list button 501 is used to instruct the controller 400 to display a sheet list window 530. When a user selects the sheet list button 501, the controller 400 display the sheet list window 530 in a state superimposed on the top screen 500. A setting button 502 is used to change a system configuration of the sheet management application 453.

Figure 6:
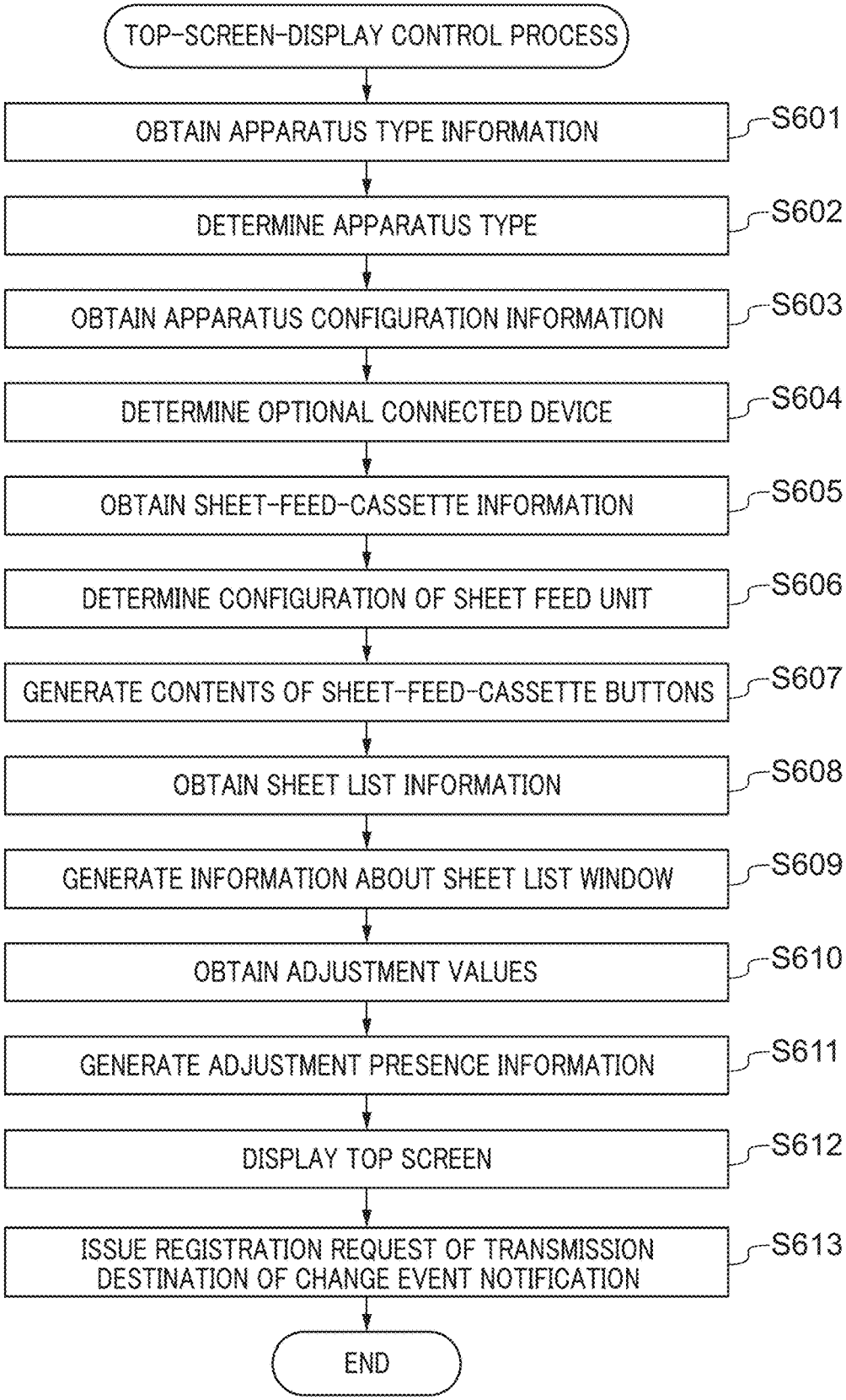
FIG. 6 is a flowchart showing procedures of a top-screen-display control process executed by the print control apparatus in FIG. 1.

FIG. 6 is a flowchart showing procedures of a top-screen-display control process executed by the print control apparatus 102 in FIG. 1. The process in FIG. 6 is achieved because the CPU 401 runs programs that are developed onto the RAM 402. The process in FIG. 6 is executed when the sheet management application 453 starts, for example.

As shown in FIG. 6, the CPU 401 inquires of the image forming apparatus 103 connected to the print control apparatus 102 about apparatus type information including information showing the apparatus type of the image forming apparatus 103 concerned, and obtains the apparatus type information from the image forming apparatus 103 (step S601). Next, the CPU 401 determines the apparatus type of the image forming apparatus 103 on the basis of the apparatus type information obtained in the step S601 and apparatus-type discrimination information held beforehand in the ROM 403 etc. (step S602). The apparatus-type discrimination information includes information showing apparatus types that are beforehand registered into the print control apparatus 102, for example. Next, the CPU 401 inquires of the image forming apparatus 103 about apparatus configuration information and obtains the apparatus configuration information from the image forming apparatus 103 (step S603). The apparatus configuration information includes information showing the reading device 117 and the sheet feed unit 116 that are connected to the image forming apparatus 103 as options, for example. Next, the CPU 401 determines devices (hereinafter referred to as "optional connected devices") connected to the image forming apparatus 103 as options on the basis of the obtained apparatus configuration information (step S604).

Next, the CPU 401 inquires of the image forming apparatus 103 about the sheet-feed-cassette information and obtains the sheet-feed-cassette information from the image forming apparatus 103 (step S605). The sheet-feed-cassette information includes configuration information about the sheet feed unit 116, sheet attributes, and automatic pull-out capabilities. The configuration information about the sheet feed unit 116 shows the configuration of the sheet feed unit 116, such as the sheet feed cassettes, a manual feed tray, and a long sheet tray. The sheet attributes show a type and size of sheets stored in each sheet feed cassette of the sheet feed unit 116. The automatic pull-out capability shows whether each sheet feed cassette of the sheet feed unit 116 is configured to enable automatic pull-out in response to selection of the sheet-feed-cassette open button. Next, the CPU 401 determines the configuration of the sheet feed unit 116 on the basis of the sheet-feed-cassette information received in the step S605 (step S606). In the step S606, the CPU 401 determines the number of the sheet feed cassettes that constitute the sheet feed unit 116 and determines whether each sheet feed cassette that constitutes the sheet feed unit 116 can be automatically pulled out in response to selection of the corresponding sheet-feed-cassette open button, for example. Next, the CPU 401 generates contents of the sheet-feed-cassette buttons 510 through 517 displayed on the top screen 500 on the basis of the determination result in the step S606 (step S607). The contents of the sheet-feed-cassette buttons 510 through 517 are displayed on the sheet-feed-cassette buttons 510 through 517. The contents of each the sheet-feed-cassette buttons 510 through 517 include the attributes, such as a type, size, basis weight, and remaining amount, about the sheets stored in a corresponding sheet feed cassette. Moreover, the contents of a sheet-feed-cassette button corresponding to a sheet feed cassette that is configured to enable the automatic pull-out in response to the selection of a sheet-feed-cassette open button include information about a sheet-feed-cassette open button displayed on the sheet-feed-cassette button in addition to the above-mentioned contents.

Next, the CPU 401 inquires of the image forming apparatus 103 about the sheet list information and obtains the sheet list information from the image forming apparatus 103 (step S608). The sheet list information shows a list of sheets of which the attributes and adjustment values are already registered to the print control apparatus 102, for example. Next, the CPU 401 generates information about the sheet list window 530 displayed on the top screen 500 on the basis of the obtained sheet list information (step S609). Next, the CPU 401 inquires of the image forming apparatus 103 about the adjustment values and obtains the adjustment values from the image forming apparatus 103 (step S610). Next, the CPU 401 generates adjustment presence information on the basis of the obtained adjustment values (step S611). In the step S611, when the adjustment value has not been changed from a default value, the CPU 401 generates "not adjusted" as the adjustment presence information. Moreover, when the adjustment value has been changed from the default value, the CPU 401 generates "adjusted" as the adjustment presence information. Next, the CPU 401 displays the top screen 500, which is generated on the basis of the apparatus type information, the apparatus configuration information, the contents of the sheet-feed-cassette buttons 510 through 517, the information about the sheet list window 530, and the adjustment presence information, on the external display device 113 (step S612). Next, the CPU 401 issues a registration request of the transmission destination of the change event notification mentioned above to the image forming apparatus 103 (step S613). When receiving the registration request, the image forming apparatus 103 sets the transmission destination of the change event notification to the print control apparatus 102. Thereby, the image forming apparatus 103 transmits the change event notification to the print control apparatus 102, when at least one of the sheet-feed-cassette information and the sheet information of the image forming apparatus 103 is changed. After that, the top-screen-display control process is finished.

Although the above-mentioned process in FIG. 6 describes the case where the execution trigger of the top-screen-display control process is the start of the sheet management application 453, the execution trigger of the top-screen-display control process is not restricted to this. For example, the process in FIG. 6 may be started when the sheet-feed-cassette information or the sheet information is updated in the image forming apparatus 103.

FIG. 7 is a flowchart showing procedures of an initialization process executed by the image forming apparatus 103 in FIG. 1. The process in FIG. 7 is achieved because the CPU 301 runs programs that are developed onto the RAM 302. The process in FIG. 7 is executed in starting the image forming apparatus 103, for example.

As shown in FIG. 7, the CPU 301 obtains the information that shows the apparatus type of the image forming apparatus 103 from the external storage unit 311, and generates apparatus type information on the basis of the obtained information (step S701). Next, the CPU 301 obtains the information that shows the reading device 117 and sheet feed unit 116, which are connected to the image forming apparatus 103 as options, from the external storage unit 311, and generates the apparatus configuration information on the basis of the obtained information (step S702). Next, the CPU 301 obtains the configuration information about the sheet feed unit 116, the sheet attributes, and the automatic pull-out capabilities from the external storage unit 311, and generates the sheet-feed-cassette information on the basis of these pieces of obtained information (step S703). Next, the CPU 301 obtains the sheet information about the sheets that have been already registered to the print control apparatus 102 from the external storage unit 311, and generates the sheet list information on the basis of the obtained sheet information (step S704). Next, the CPU 301 obtains the adjustment values of all the adjustable items in the image forming apparatus 103 from the external storage unit 311 (step S705). Next, the CPU 301 waits until receiving an access request from an external apparatus. When an access request is received from an external apparatus, for example, the print control apparatus 102, the CPU 301 determine whether an inquiry about the apparatus type information is received from the print control apparatus 102 (step S706).

As a result of the determination in the step S706, when the inquiry about the apparatus type information is not received from the print control apparatus 102, the initialization process proceeds to a step S708 mentioned later. As a result of the determination in the step S706, when the inquiry about the apparatus type information is received from the print control apparatus 102, the CPU 301 transmits the apparatus type information generated in the step S701 to the print control apparatus 102 (step S707). Next, the CPU 301 determines whether an inquiry about the apparatus configuration information is received from the print control apparatus 102 (step S708).

As a result of the determination in the step S708, when the inquiry about the apparatus configuration information is not received from the print control apparatus 102, the initialization process proceeds to a step S710 mentioned later. As a result of the determination in the step S708, when the inquiry about the apparatus configuration information is received from the print control apparatus 102, the CPU 301 transmits the apparatus configuration information generated in the step S702 to the print control apparatus 102 (step S709). Next, the CPU 301 determines whether an inquiry about the sheet-feed-cassette information is received from the print control apparatus 102 (step S710).

As a result of the determination in the step S710, when the inquiry about the sheet-feed-cassette information is not received from the print control apparatus 102, the initialization process proceeds to a step S712 mentioned later. As a result of the determination in the step S710, when the inquiry about the sheet-feed-cassette information is received from the print control apparatus 102, the CPU 301 transmits the sheet-feed-cassette information generated in the step S703 to the print control apparatus 102 (step S711). Next, the CPU 301 determines whether an inquiry about the sheet list information is received from the print control apparatus 102 (step S712).

As a result of the determination in the step S712, when the inquiry about the sheet list information is not received from the print control apparatus 102, the initialization process proceeds to a step S714 mentioned later. As a result of the determination in the step S712, when the inquiry about the sheet list information is received from the print control apparatus 102, the CPU 301 transmits the sheet list information generated in the step S704 to the print control apparatus 102 (step S713). Next, the CPU 301 determines whether an inquiry about the adjustment values is received from the print control apparatus 102 (step S714).

As a result of the determination in the step S714, when the inquiry about the adjustment values is not received from the print control apparatus 102, the initialization process proceeds to a step S716 mentioned later. As a result of the determination in the step S714, when the inquiry about the adjustment values is received from the print control apparatus 102, the CPU 301 transmits the adjustment values obtained in the step S705 to the print control apparatus 102 (step S715). Next, the CPU 301 determines whether the registration request of the transmission destination of the change event notification is received from the print control apparatus 102 (step S716).

As a result of the determination in the step S716, when the registration request of the transmission destination of the change event notification is not received from the print control apparatus 102, the initialization process proceeds to a step S718 mentioned later. As a result of the determination in the step S716, when the registration request of the transmission destination of the change event notification is received from the print control apparatus 102, the CPU 301 performs a registration process (step S717) and registers the print control apparatus 102 as the transmission destination of the change event notification. Next, the CPU 301 determines whether the processes corresponding to the inquiries and the registration request received from the print control apparatus 102 have been finished (step S718). For example, when all of the processes in the steps S707, S709, S711, S713, S715, and S717 are completed, the CPU 301 determines that the processes corresponding to the inquiries and the registration request received from the print control apparatus 102 have been finished. In the meantime, when at least one of the processes in the steps S707, S709, S711, S713, S715, and S717 is not completed, the CPU 301 determines that the processes corresponding to the inquiries and the registration request received from the print control apparatus 102 have not been finished.

As a result of the determination in the step S718, when the processes corresponding to the inquiries and the registration request received from the print control apparatus 102 have not been finished, the initialization process returns to the step S706. As a result of the determination in the step S718, when the processes corresponding to the inquiries and the registration request received from the print control apparatus 102 have been finished, the initialization process is finished.

FIG. 8 is a view showing an example of the sheet setting management table 800 managed by the sheet management application 453 in FIG. 4B. The sheet management application 453 is able to edit, add, delete, and search the sheet information in the sheet setting management table 800. The sheet setting management table 800 is a management table for managing the sheet information for every sheet ID and is stored in the external storage unit 409 that is a nonvolatile storage device. Although the embodiment describes the configuration that the sheet setting management table 800 is stored in the external storage unit 409, the storage location of the sheet setting management table 800 is not limited to the external storage unit 409. For example, the sheet setting management table 800 may be stored in the external storage unit 311 of the image forming apparatus 103. In such a configuration, the print control apparatus 102 obtains the sheet setting management table 800 from the image forming apparatus 103 and stores the sheet setting management table 800 concerned into the RAM 402. The sheet management application 453 manages the sheet setting management table 800 stored in the RAM 402.

In the sheet setting management table 800, the attributes and the adjustment values of the adjustment items of a sheet are registered in association with a sheet ID that specifies a sheet. Specifically, the sheet attributes include a sheet name, basis weight, size, width, height, and surface nature. The adjustment items include a sheet conveyance speed of the first fixing unit 211, a sheet conveyance speed of the second fixing unit 213, a primarily transfer voltage, an image position, and a secondary transfer voltage, for example.

Figure 9:
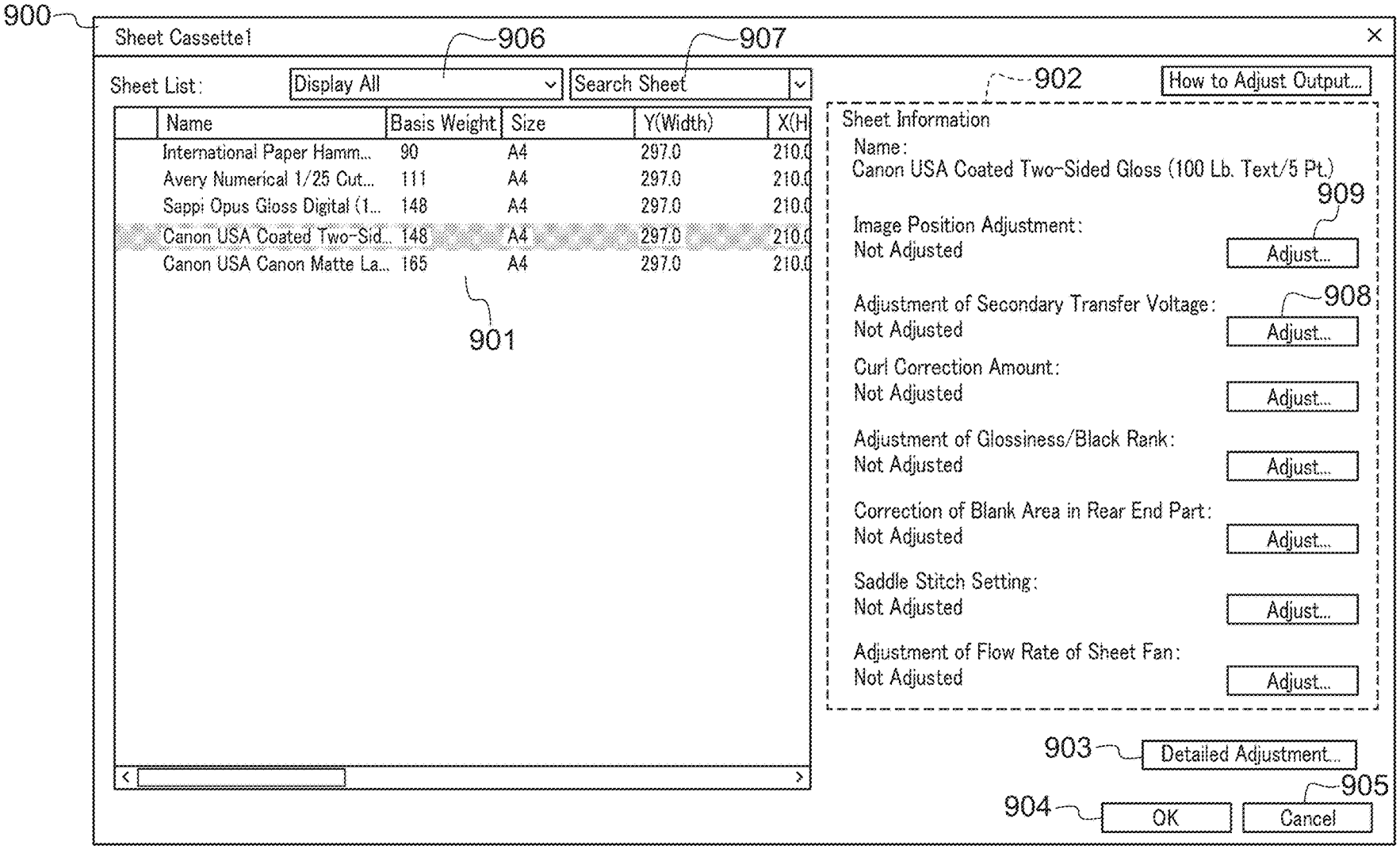
FIG. 9 is a view showing an example of a sheet-feed-cassette screen displayed on an external display device in selecting a sheet feed cassette button on the top screen in FIG. 5.

FIG. 9 is a view showing an example of the sheet-feed-cassette screen displayed on the external display device 113 in selecting the sheet-feed-cassette button 510 on the top screen 500 in FIG. 5. The sheet-feed-cassette screen 900 is provided with a sheet list display area 901, a sheet information display area 902, a detailed adjustment button 903, an OK button 904, and a cancel button 905. Furthermore, the sheet-feed-cassette screen 900 is provided with a pull down menu 906 for selecting a display method of the sheet list and a retrieval word input area 907.

The sheet list is displayed in the sheet list display area 901. In FIG. 9, the types of the sheets are displayed in a column direction and the attributes, such as the basis weight and size, are displayed in a row direction. In the sheet list display area 901, the information about the sheet selected by a user is highlighted so that the user can easily recognize the selection state of the sheet. In the embodiment, when a user selects the sheet-feed-cassette button 510, the sheet-feed-cassette screen 900 is displayed in the state where the sheet information set to the sheet feed cassette corresponding to the sheet-feed-cassette button 510 is selected in the sheet list display area 901. When the user selects another sheet in the sheet list display area 901, the information about the selected sheet is displayed in the sheet information display area 902. When the user selects the OK button 904 in the state where the other sheet is selected in the sheet list display area 901, the controller 400 performs sheet setting to the image forming apparatus 103 on the basis of the information about the sheet that the user selects in the sheet list display area 901. In the meantime, when the user selects the cancel button 905 in the state where the other sheet is selected in the sheet list display area 901, the controller 400 closes the sheet-feed-cassette screen 900 without performing the sheet setting to the image forming apparatus 103.

In the sheet information display area 902, information that the user uses frequently is displayed from among the pieces of sheet information that are selected by the user. Specifically, the information includes a name of a sheet and some adjustment items, such as image position adjustment, adjustment of a secondary transfer voltage, a curl correction amount, adjustment of glossiness/black rank, correction of blank area in a rear end part, a saddle stitch setting, and adjustment of flow rate of a sheet fan. In the sheet information display area 902, a determination result of whether an adjustment value of each adjustment item has been changed from an initial value of the image forming apparatus 103 is displayed. For example, a message "not adjusted" is displayed to an adjustment item of which an adjustment value is not changed from an initial value, and a message "adjusted" is displayed to an adjustment item of which an adjustment value is changed from an initial value. Moreover, in the sheet information display area 902, the adjustment buttons are displayed to the adjustment items of which the adjustment values can be changed from the print control apparatus 102. For example, when the user selects the adjustment button 908, an automatic adjustment setting screen 1300 of the secondary transfer voltage shown in FIG. 13A mentioned later is displayed on the external display device 113.

The detailed adjustment button 903 is used to instruct display of detailed information that is not displayed on the sheet information display area 902. In the pull-down menu 906, options for filtering and displaying the sheet displayed on the sheet list display area 901 can be displayed. The retrieval word input area 907 is used to input a keyword that the user retrieves a desired sheet from among the sheets displayed in the sheet list display area 901. Incremental search is available in the retrieval word input area 907. Whenever a character is input, the sheets are searched automatically.

Figure 10A:
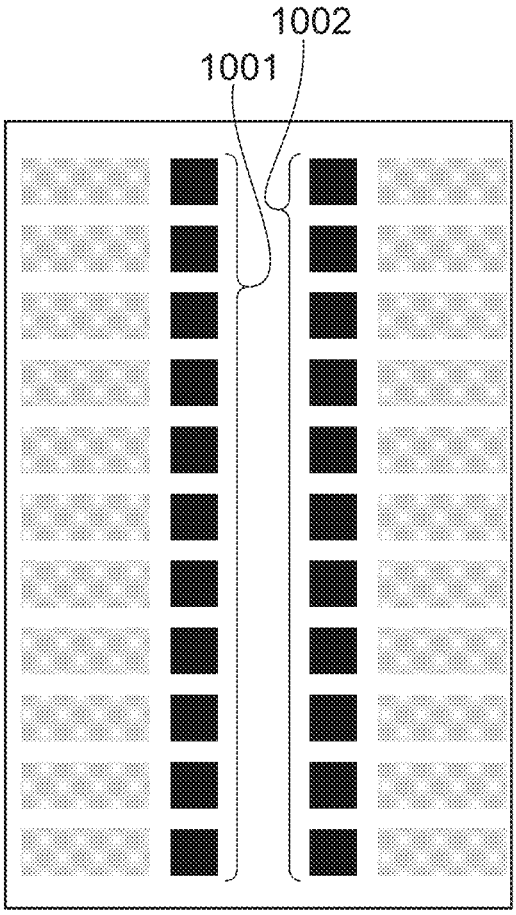
FIG. 10A and FIG. 10B are views showing examples of charts printed with a print engine in FIG. 2.
Figure 10B:
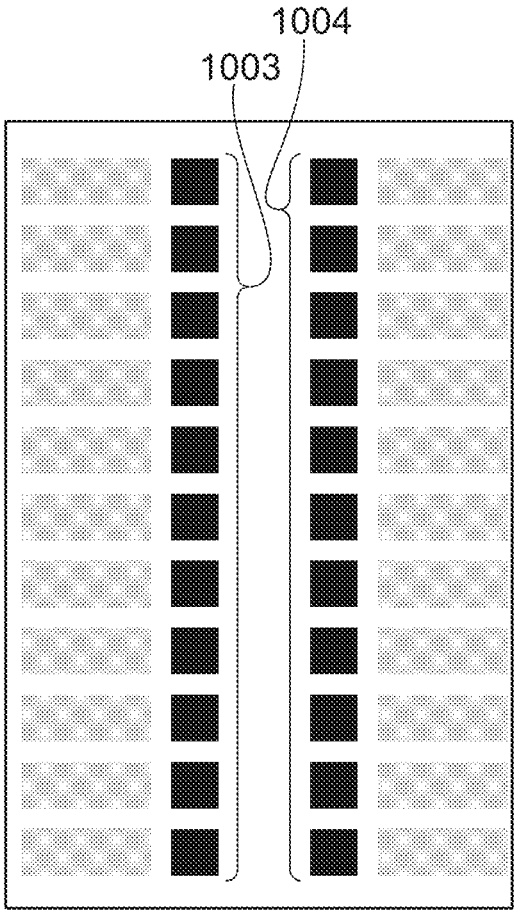

Next, the adjustment of the secondary transfer voltage in the embodiment will be described. For example, when a sheet of a type that is different in the water content or the resistance is used to print, optimal transfer may be impossible when a secondary transfer voltage is a default value. The secondary transfer voltage is set to a value that is necessary to transfer the toner on the intermediate transfer medium and does not cause abnormal discharge. For example, when resistance of a sheet used to print is larger than a standard value, the default value of the secondary transfer voltage is short, and it is necessary to apply a voltage larger than the default value as the secondary transfer voltage. Moreover, when water content of a sheet used to print is smaller than a standard value, abnormal discharge tends to occur, which causes image defect when the secondary transfer voltage is the default value. In such a case, it is necessary to apply a voltage smaller than the default value as the secondary transfer voltage. In this way, it is necessary to control the secondary transfer voltage to a suitable value in accordance with the type of the sheet used to print. Taking this into consideration, the image forming apparatus 103 automatically adjusts the secondary transfer voltage according to the instruction received from the print control apparatus 102 in the embodiment. In the automatic adjustment of the secondary transfer voltage, the image forming apparatus 103 prints a coarse adjustment chart (first chart) shown in FIG. 10A or a fine adjustment chart (second chart) shown in FIG. 10B, reads the printed chart with the reading device 117, and determines the adjustment value of the secondary transfer voltage so that the transfer efficiency will fall within a stipulated range.

The coarse adjustment chart and fine adjustment chart are formed while changing the secondary transfer voltage by a predetermined pitch width so as to print different patches for the respective secondary transfer voltages. For example, the coarse adjustment chart is formed while changing the secondary transfer voltage from the adjustable minimum value 1750V to the adjustable maximum value 3250V at the pitch width 150V, so that blue solid patches 1001 and black solid patches 1002 are printed. The coarse adjustment chart is used to adjust the secondary transfer voltage roughly. For example, the coarse adjustment chart is used in a case where the secondary transfer voltage is automatically adjusted to an unadjusted sheet.

The fine adjustment chart is formed while changing the secondary transfer voltage within a specific range from 2500V to 3000V at the pitch width 50V in the adjustable range of the secondary transfer voltage, so that blue solid patches 1003 and black solid patches 1004 are printed. In print of the fine adjustment chart, the secondary transfer voltage can be adjusted at the pitch width finer than that of the coarse adjustment chart. The fine adjustment chart is used when the secondary transfer voltage is adjusted more finely after adjustment by using the coarse adjustment chart or when the secondary transfer voltage to the adjusted sheet is readjusted because of a lapse of time. The reading device 117 reads these charts with the image pickup unit 325 according to instructions from the CPU 322 and stores the read result into the RAM 324. Moreover, the CPU 301 is notified of the read result through the communication I/F 321 and reading-device I/F 315. The CPU 301 stores the obtained reading result into the RAM 302 and determines whether both the transfer efficiencies of the blue solid patches and the black solid patches fall within the stipulated range.

Figure 11:
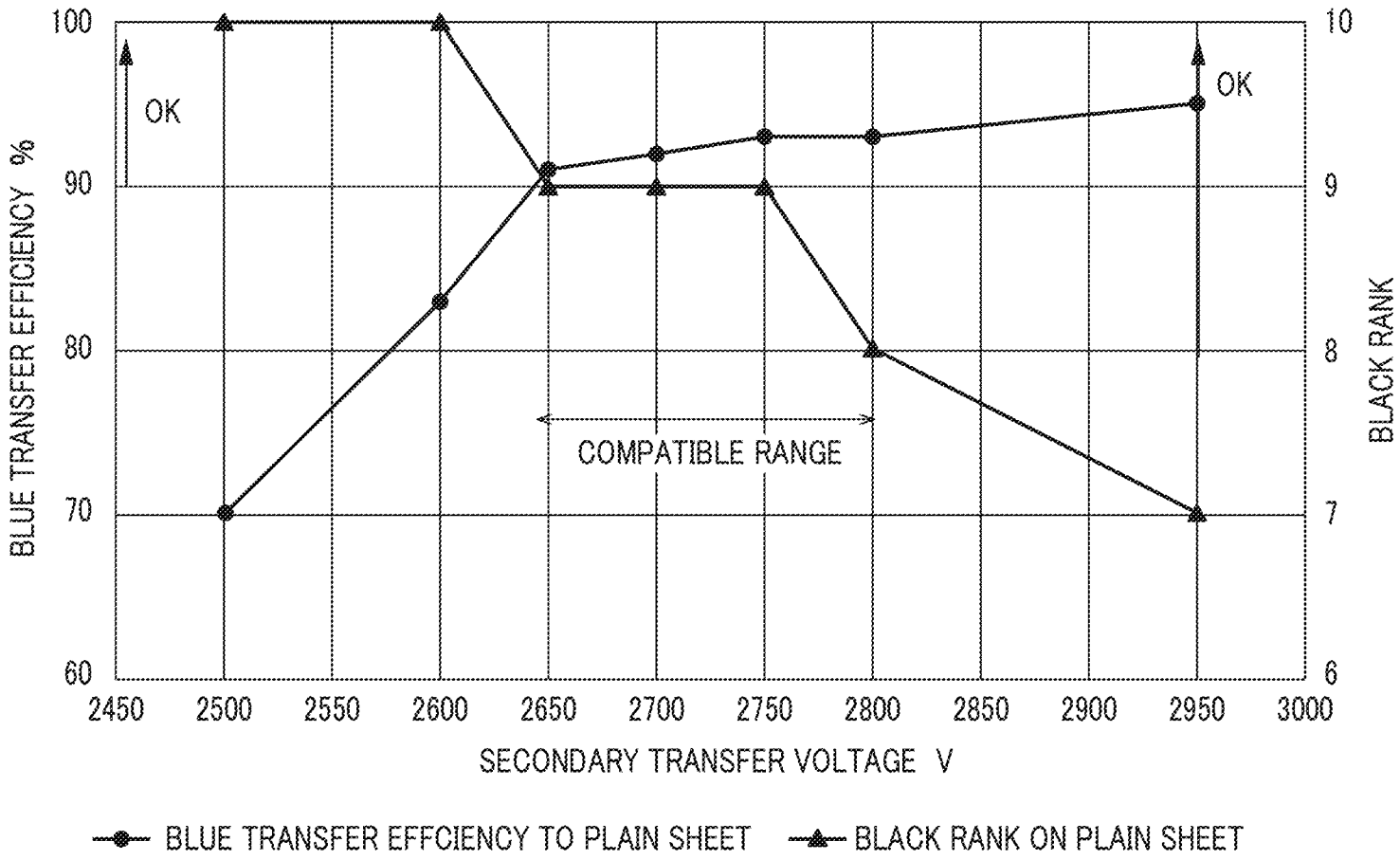
FIG. 11 is a graph showing an example of a result that a reading device in FIG. 1 reads.

FIG. 11 is a graph showing an example of a result that the reading device 117 in FIG. 1 reads. In the example in FIG. 11, 90% or more of the transfer efficiency of the blue solid is OK and "8" or more of the black rank is OK. In FIG. 11, when the secondary transfer voltage falls within the range 2650V through 2800V, the printed chart satisfies both the condition of the transfer efficiency of the blue solid and the black rank. The CPU 301 stores the smallest voltage 2650V within the range 2650V through 2800V into the external storage unit 311, for example, and decides the adjustment value of the secondary transfer voltage of the applicable sheet on the basis of this voltage value. Although the adjustment value of the secondary transfer voltage is decided on the basis of the smallest voltage 2650V within the range 2650V through 2800V in the embodiment, the present invention is not restricted to this. For example, the adjustment value of the secondary transfer voltage may be decided on the basis of the voltage value that maximizes the transfer efficiency of the blue solid and the black rank within the range 2650V through 2800V. Moreover, when "front side only" is set as the setting about the automatic adjustment of the secondary transfer voltage, the adjustment value of the secondary transfer voltage only for the front side is stored. In the meantime, when "both sides" is set as the setting about the automatic adjustment of the secondary transfer voltage, the adjustment values for the front side and back side are stored, respectively. When the "both sides" is set as the setting about the automatic adjustment of the secondary transfer voltage, blue solid patches and black solid patches are printed on both sides so that the patches in the front side will not overlap with the patches in the back side in order to avoid influence on the reading result.

FIG. 12 is a flowchart showing procedures of a secondary-transfer-voltage adjustment process executed by the print system 100 in FIG. 1. The secondary-transfer-voltage adjustment process includes a process by the sheet management application 453 and a process by the image forming apparatus 103. The process by the sheet management application 453 is controlled by the sheet management application 453 and is achieved because the CPU 401 runs the program that is developed onto the RAM 402. The process by the image forming apparatus 103 is achieved because the CPU 301 runs the program that is developed onto the RAM 302. In the secondary-transfer-voltage adjustment process, the process accompanied by communication between the sheet management application 453 and the controller 300 is executed by the CPUs 301 and 401 through the LAN controller 306, control cable 108, and LAN controller 406.

The secondary-transfer-voltage adjustment process is executed when a user selects a sheet feed button corresponding to a sheet feed cassette subjected to the automatic adjustment from among the sheet-feed-cassette buttons 510 through 517 on the top screen 500 and selects the adjustment button 908 on the sheet-feed-cassette screen 900 displayed on the external display device 113. It should be noted that the secondary-transfer-voltage adjustment process assumes that the above-mentioned top-screen-display control process has been already executed.

As shown in FIG. 12, the sheet management application 453 first determines whether the reading device 117 is connected to the image forming apparatus 103 on the basis of the apparatus configuration information obtained in the step S603 (step S1201).

Figure 13A:
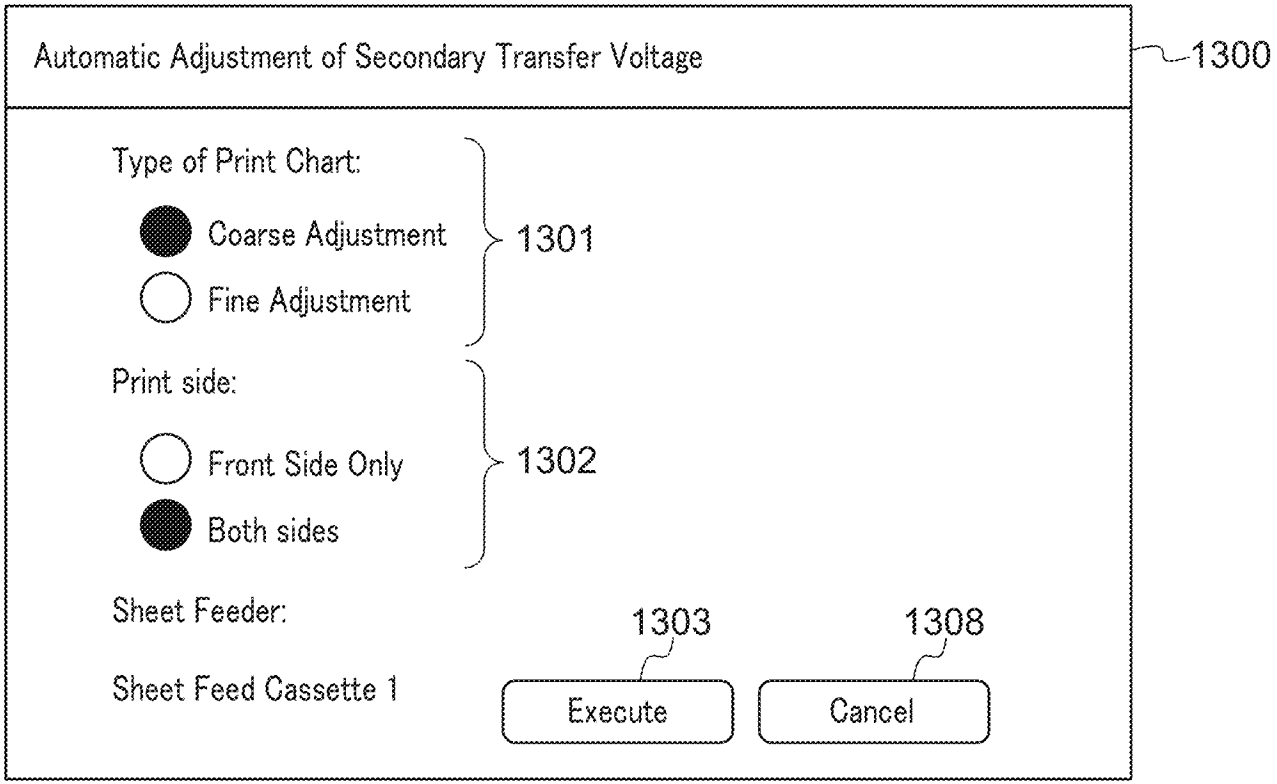
FIG. 13A, FIG. 13B, FIG. 13C, and FIG. 13D are views showing examples of screens displayed on an external display device in FIG. 4A.

As a result of the determination in the step S1201, when the reading device 117 is not connected to the image forming apparatus 103, the secondary-transfer-voltage adjustment process proceeds to a step S1216 mentioned later. As a result of the determination in the step S1201, when the reading device 117 is connected to the image forming apparatus 103, the sheet management application 453 displays the automatic adjustment setting screen 1300 about the secondary transfer voltage on the external display device 113 as shown in FIG. 13A (step S1202).

The automatic adjustment setting screen 1300 about the secondary transfer voltage is provided with a chart-type setting area 1301, a print-side setting area 1302, an execution button 1303, and a cancel button 1304. The chart-type setting area 1301 includes radio buttons that are used to set up a type of a chart that will be printed in the automatic adjustment of the secondary transfer voltage. The user can select either one of "fine adjustment" that shows the fine adjustment chart and "coarse adjustment" that shows the coarse adjustment chart by operating the radio buttons. The print-side setting area 1302 includes radio buttons that are used to set up a print side that is subjected to the automatic adjustment of the secondary transfer voltage. The user can select either one of "front side only" showing that only the front side is subjected to the automatic adjustment of the secondary transfer voltage and "both sides" showing that the both sides are subjected to the automatic adjustment of the secondary transfer voltage by operating the radio buttons. The execution button 1303 is used to instruct the image forming apparatus 103 to execute the automatic adjustment of the secondary transfer voltage by using the settings on the automatic adjustment setting screen 1300 about the secondary transfer voltage. The cancel button 1304 is used to instruct the image forming apparatus 103 to close the automatic adjustment setting screen 1300 about the secondary transfer voltage and to display of the sheet-feed-cassette screen 900 again without instructing the image forming apparatus 103 to execute the automatic adjustment of the secondary transfer voltage. The sheet management application 453 waits until the user selects the execution button 1303 or the cancel button 1304.

When the user selects the execution button 1303 or the cancel button 1304, the sheet management application 453 determines which of the execution button 1303 or the cancel button 1304 is selected by the user (step S1203).

As a result of the determination in the step S1203, when the user selects the cancel button 1304, the secondary-transfer-voltage adjustment process is finished. As a result of the determination in the step S1203, when the user selects the execution button 1303, the secondary-transfer-voltage adjustment process proceeds to a step S1204. In the step S1204, the sheet management application 453 stores (holds) the adjustment value of the secondary transfer voltage of the sheet stored in the sheet feed cassette selected by the user on the top screen 500 into the RAM 402. Next, the sheet management application 453 instructs the image forming apparatus 103 to execute the automatic adjustment of the secondary transfer voltage for the sheet stored in the sheet feed cassette selected by the user on the basis of the settings on the automatic adjustment setting screen 1300 about the secondary transfer voltage (step S1205).

Figure 14A:
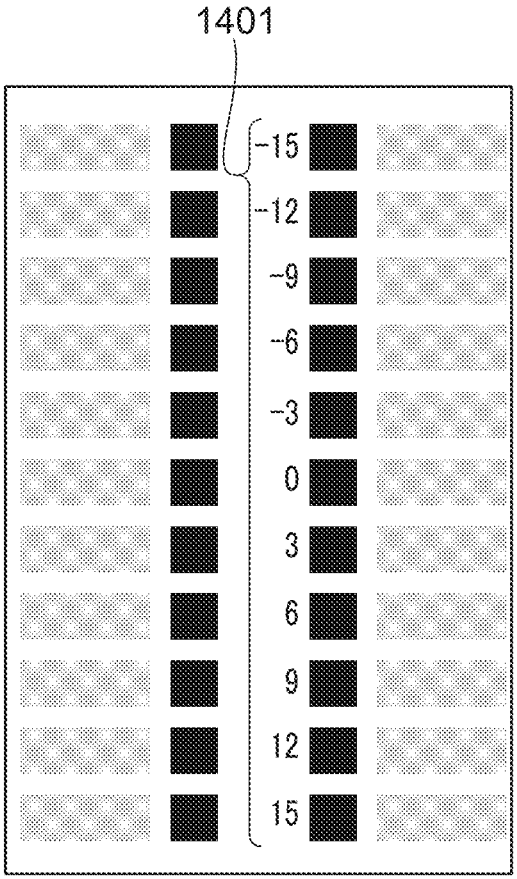
FIG. 14A and FIG. 14B are views showing examples of charts printed on sheets in the embodiment.
Figure 14B:
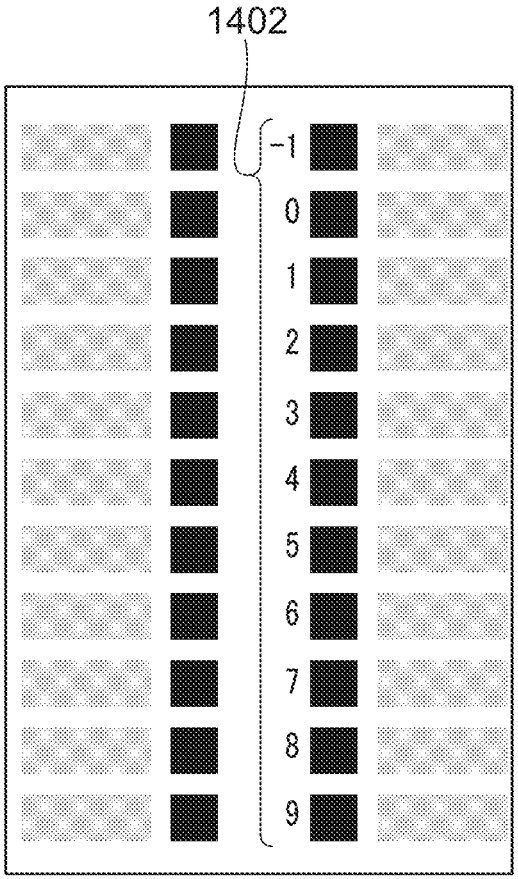

When receiving the execution instruction (step S1206), the CPU 301 of the image forming apparatus 103 automatically adjusts the secondary transfer voltage for the sheet stored in the sheet feed cassette selected by the user according to the received execution instruction (step S1207). In the step S1207, the coarse adjustment chart in FIG. 14A or the fine adjustment chart in FIG. 14B is printed according to the setting set in the chart-type setting area 1301. The image forming apparatus 103 reads the chart with the reading device 117 and decides the adjustment value of the secondary transfer voltage so that the transfer efficiency falls within the stipulated range. Although the configurations of the charts in FIG. 14A and FIG. 14B are basically identical to that in FIG. 10A and FIG. 10B, they differ in that adjustment values 1401 and 1402 are printed in association with the patches. Although the printed adjustment values are not used in the automatic adjustment of the secondary transfer voltage, they are used when the user readjusts the secondary transfer voltage adjusted by the automatic adjustment. When the automatic adjustment is completed, the CPU 301 stores the adjustment value of the secondary transfer voltage after adjustment into the external storage unit 311. Moreover, the CPU 301 transmits an automatic adjustment completion notice showing that the automatic adjustment of the secondary transfer voltage has been completed to the print control apparatus 102 (step S1208).

When receiving the automatic adjustment completion notice (step S1209), the sheet management application 453 of the print control apparatus 102 requests the adjustment value of the secondary transfer voltage after adjustment from the image forming apparatus 103 (step S1210). When receiving a request for the adjustment value of the secondary transfer voltage after adjustment (step S1211), the CPU 301 of the image forming apparatus 103 transmits the adjustment value of the secondary transfer voltage after the adjustment stored in the external storage unit 311 to the print control apparatus 102 (step S1212).

Figure 13B:
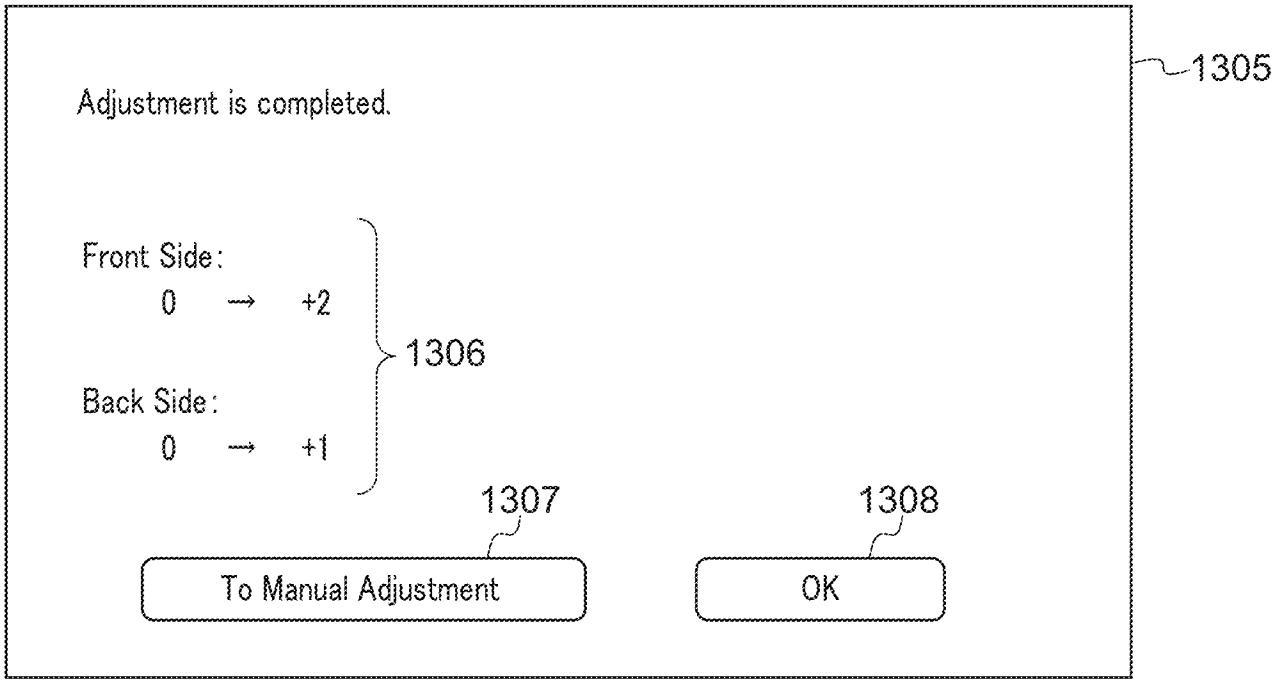
Figure 13C:
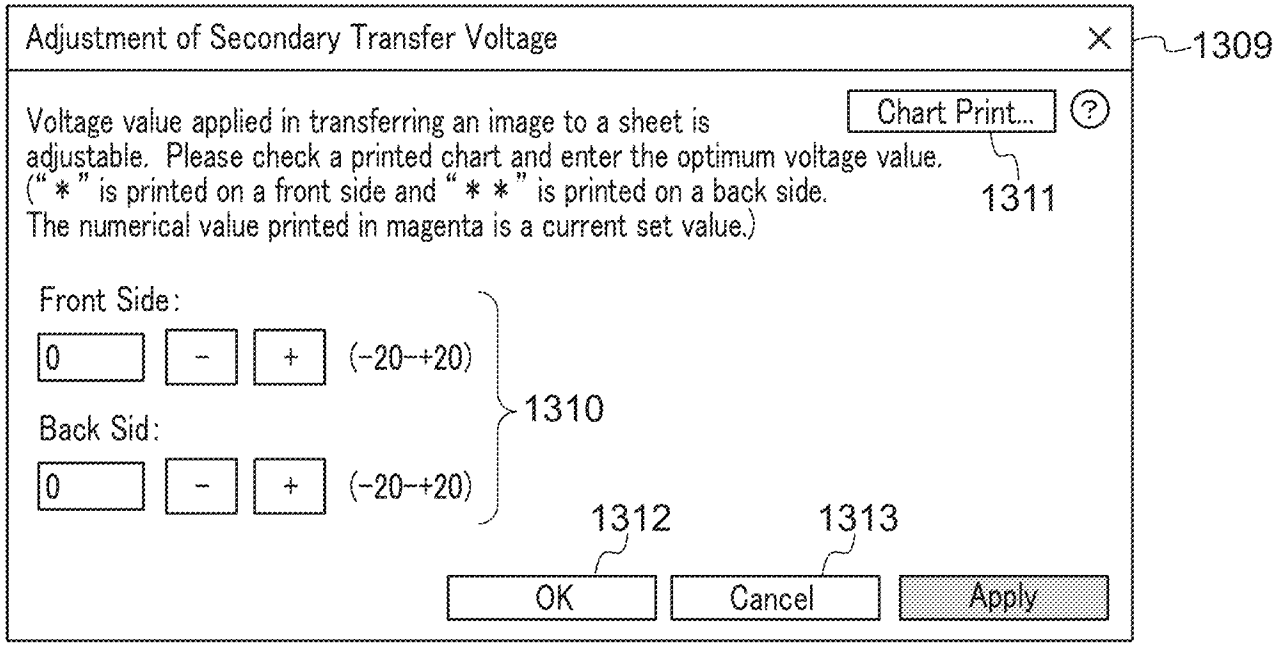

When receiving the adjustment value of the secondary transfer voltage after adjustment (step S1213), the sheet management application 453 of the print control apparatus 102 displays an execution result screen 1305 shown in FIG. 13B on the external display device 113 (step S1214). The execution result screen 1305 is provided with an execution-result display area 1306, a manual adjustment button (an object) 1307, and an OK button 1308. The adjustment value stored in the step S1204 (i.e., the adjustment value of the secondary transfer voltage before the automatic adjustment in the step S1207) and the adjustment value of the secondary transfer voltage after the automatic adjustment in the step S1207 are displayed in the execution-result display area 1306. FIG. 13B shows that the adjustment value of the secondary transfer voltage of the front side is changed into "+2" from "0", and the adjustment value of the secondary transfer voltage of the back side is changed into "+1" from "0". The manual adjustment button 1307 is used to display a manual adjustment screen 1309 shown in FIG. 13C. The OK button 1308 is used to close the execution result screen 1305. The sheet management application 453 waits until the user selects the manual adjustment button 1307 or the OK button 1308. When the user selects the manual adjustment button 1307 or the OK button 1308, the sheet management application 453 determines which of the manual adjustment button 1307 or the OK button 1308 is selected by the user (step S1215).

Figure 13D:
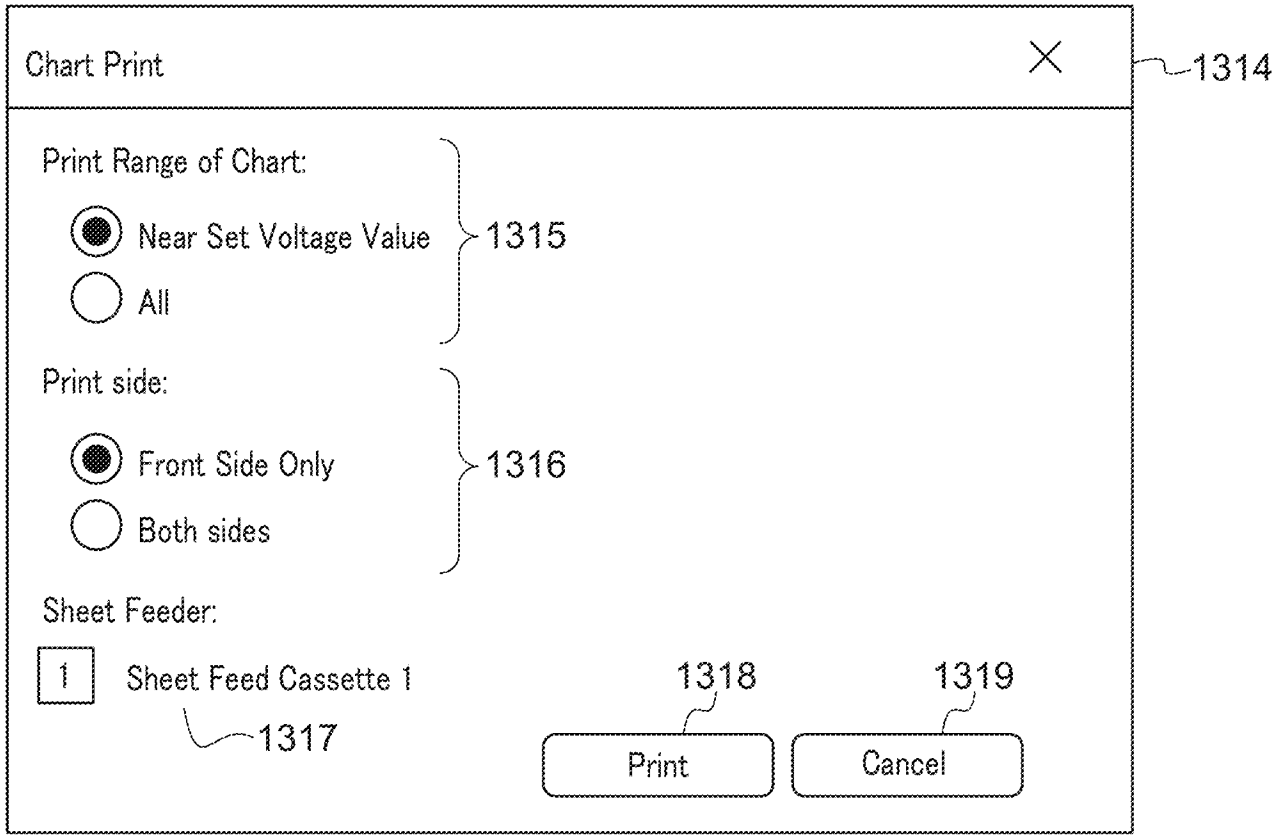

As a result of the determination in the step S1215, when the user selects the OK button 1308, the secondary-transfer-voltage adjustment process is finished. As a result of the determination in the step S1215, when the user selects the manual adjustment button 1307, the sheet management application 453 displays the manual adjustment screen (adjustment screen) 1309 on the external display device 113 (step S1216). The manual adjustment screen 1309 is provided with an adjustment value input area 1310, a chart print button 1311, an OK button 1312, and a cancel button 1313. The adjustment value of the secondary transfer voltage is designated in the adjustment value input area 1310. The user can readjust the secondary transfer voltage adjusted by the automatic adjustment by directly inputting an adjustment value of the secondary transfer voltage into a text box or by operating plus/minus buttons to designate an adjustment value of the secondary transfer voltage. In the step S1216, the manual adjustment screen 1309 is displayed in the state where the adjustment value of the secondary transfer voltage after adjustment received from the image forming apparatus 103 in the step S1213 are input into the adjustment value input area 1310. The chart print button 1311 is used to display a chart setting screen 1314 shown in FIG. 13D. The OK button 1312 is used to transmit the adjustment value input into the adjustment value input area 1310 to the image forming apparatus 103. The cancel button 1313 is used to close the manual adjustment screen 1309.

Next, the sheet management application 453 determines whether the user selects the chart print button 1311 on the manual adjustment screen 1309 (step S1217). As a result of the determination in the step S1217, when the user does not select the chart print button 1311 on the manual adjustment screen 1309, the secondary-transfer-voltage adjustment process proceeds to a step S1221 mentioned later.

As a result of the determination in the step S1217, when the user selects the chart print button 1311 on the manual adjustment screen 1309, the sheet management application 453 displays the chart setting screen 1314 on the external display device 113. The chart setting screen 1314 is provided with a chart-type setting area 1315, a print-side setting area 1316, a sheet-feed-cassette setting area 1317, a print button 1318, and a cancel button 1319. The chart-type setting area 1315 includes radio buttons that can set either one of "near set voltage value" and "all". When the "near set voltage value" is selected, a fine adjustment chart is printed while changing the secondary transfer voltage gradually in a plus direction and a minus direction on the basis of the adjustment value input into the adjustment value input area 1310. When the "all" is selected, a coarse adjustment chart is printed while changing the secondary transfer voltage gradually from the minimum adjustable value to the maximum adjustable value of the secondary transfer voltage. The print-side setting area 1316 includes radio buttons that are used to select either one of "front side only" and "both sides" as with the print-side setting area 1302. A numerical value showing the sheet feed cassette selected by the user on the top screen 500 is set to the sheet-feed-cassette setting area 1317. The print button 1318 is used to instruct the image forming apparatus 103 to output a chart on the basis of the settings on the manual adjustment screen 1309 and chart setting screen 1314. The cancel button 1319 is used to close the chart setting screen 1314 and to display the manual adjustment screen 1309 again.

When the user selects the print button 1318, the sheet management application 453 instructs the image forming apparatus 103 to output a chart including the settings on the manual adjustment screen 1309 and chart setting screen 1314 (step S1218, a chart-print instruction unit). Moreover, the sheet management application 453 switches the screen of the external display device 113 from the chart setting screen 1314 to the manual adjustment screen 1309.

When receiving the chart output instruction from the print control apparatus 102 (YES in a step S1219), the CPU 301 of the image forming apparatus 103 controls the print engine 210 to print the chart of the secondary transfer voltage according to the chart output instruction (step S1220). In the step S1220, the coarse adjustment chart in FIG. 14A or the fine adjustment chart in FIG. 14B is printed according to the settings in the print-side setting area 1316. It should be noted that the CPU 301 proceeds with the process to a step S1223 mentioned later without printing the chart to a sheet when the chart output instruction is not received from the print control apparatus 102.

The user checks the chart printed by the image forming apparatus 103. When the intended result is obtained by changing the adjustment value of the secondary transfer voltage to the value input on the manual adjustment screen 1309, the user selects the OK button 1312 on the manual adjustment screen 1309 currently displayed on the external display device 113 of the print control apparatus 102. In the meantime, when the intended result is not obtained even if the adjustment value of the secondary transfer voltage is changed to the value input on the manual adjustment screen 1309, and when the user wants to return the adjustment value to the adjustment value obtained by the automatic adjustment, the user selects the cancel button 1313 on the manual adjustment screen 1309.

The sheet management application 453 of the print control apparatus 102 determines whether the user selects the OK button 1312 or the cancel button 1313 on the manual adjustment screen 1309 (step S1221).

As a result of the determination in the step S1221, when the user selects the cancel button 1313 on the manual adjustment screen 1309, the secondary-transfer-voltage adjustment process is finished. As a result of the determination in the step S1221, when the user selects the OK button 1312 on the manual adjustment screen 1309, the secondary-transfer-voltage adjustment process proceeds to a step S1222. In the step S1222, the sheet management application 453 transmits the adjustment value input into the adjustment value input area 1310 in the manual adjustment screen 1309 to the image forming apparatus 103. After that, the sheet management application 453 finishes this process.

The CPU 301 of the image forming apparatus 103 stores the received adjustment value into the external storage unit 311 as the adjustment value of the secondary transfer voltage for the sheet stored in the sheet feed cassette selected by the user on the top screen 500 (step S1223) and finishes this process.

According to the above-mentioned embodiment, when the adjustment value obtained by the automatic adjustment of the secondary transfer voltage is received, the adjustment value obtained by the automatic adjustment of the secondary transfer voltage and the manual adjustment button 137 are displayed on the execution result screen 1305 (on the same screen). That is, the user is not required to perform a plurality of operations for displaying the manual adjustment screen 1309 and the information about the adjustment value of the secondary transfer voltage that is necessary to determine the necessity of readjustment of the secondary transfer voltage. Accordingly, the operability in readjusting the secondary transfer voltage that has been adjusted is improvable.

Moreover, when the adjustment value obtained by the automatic adjustment of the secondary transfer voltage is received, the adjustment values of the secondary transfer voltage before and after the automatic adjustment are displayed together with the manual adjustment button 1307 on the execution result screen 1305 in the above-mentioned embodiment. Thereby, the user easily determines whether the readjustment of the secondary transfer voltage is necessary on the basis of the difference between the adjustment values of the secondary transfer voltage before and after the automatic adjustment.

Although the present invention has been described using the above-mentioned embodiment, the present invention is not limited to the above-mentioned embodiment. For example, when the user who selected the manual adjustment button 1307 selects the chart print button 1311, the chart setting screen 1314 may be displayed in a state where the "near set voltage value" is selected in the chart-type setting area 1315. Since the adjustment value has been roughly adjusted by the automatic adjustment, when the user readjusts the secondary transfer voltage adjusted by the automatic adjustment, it is considered that the secondary transfer voltage is subjected to the fine adjustment. In such a case, it is preferable to use the fine adjustment chart that enables to adjust the secondary transfer voltage at the pitch width finer than that of the coarse adjustment chart. As compared with this, when the user who selected the manual adjustment button 1307 selects the chart print button 1311, the chart setting screen 1314 is displayed in the state where the "near set voltage value" is set in the chart-type setting area 1315 in the embodiment. The "near set voltage value" is the setting corresponding to the fine adjustment chart. Thereby, the time and effort of the user who sets the chart type is reducible in the readjustment of the adjustment value obtained by the automatic adjustment.

Moreover, when the user who selected the manual adjustment button 1307 selects the chart print button 1311, the chart setting screen 1314 may be displayed in a state where the setting about the print side in the automatic adjustment is selected in the print-side setting area 1316 in the above-mentioned embodiment. The setting of the print side in the automatic adjustment is the setting set in the print-side setting area 1302 in the automatic adjustment setting screen 1300 of the secondary transfer voltage. Thereby, the time and effort of the user who sets up the print side is reducible in the readjustment of the adjustment value obtained by the automatic adjustment.

Moreover, when the user who selected the manual adjustment button 1307 selects the chart print button 1311, the chart output instruction may be issued without displaying the chart setting screen 1314 in the above-mentioned embodiment. This chart output instruction includes the "near set voltage value" as the setting set in the chart-type setting area 1315 and the setting of the print side in the automatic adjustment as the setting set in the print-side setting area 1316. Thereby, the time and effort of the user who sets up the various settings on the chart setting screen 1314 is reducible.

In the above-mentioned embodiment, when the fine adjustment chart is printed in the automatic adjustment of the secondary transfer voltage, the sheet management application 453 may control so as not to accept the operation of the chart output instruction from the user who selected the manual adjustment button 1307. When the user readjusts the secondary transfer voltage that has been automatically adjusted as mentioned above, it is considered that the secondary transfer voltage is adjusted finely. That is, it is considered that an adjustment value near the adjustment value decided by the automatic adjustment is set up. In the meantime, as shown in FIG. 14B, the fine adjustment chart printed in the automatic adjustment includes a plurality of patches corresponding to adjustment values near the adjustment value decided by the automatic adjustment in addition to a patch corresponding to the adjustment value decided by the automatic adjustment. Furthermore, the adjustment values are printed in association with the respective patches. There is extremely high possibility that the above-mentioned fine adjustment chart includes a patch corresponding to the adjustment value that the user inputs in the adjustment value input area 1310. Accordingly, the user is able to readjust the secondary transfer voltage while visually checking the fine adjustment chart output in adjusting the secondary transfer voltage automatically. And there is no need of newly printing a chart. In the embodiment, when the fine adjustment chart is printed in the automatic adjustment of the secondary transfer voltage, the sheet management application 453 controls so as not to accept the operation of the chart output instruction from the user who selected the manual adjustment button 1307.

FIG. 15 is a flowchart showing procedures of a secondary-transfer-voltage adjustment process executed by the print system 100 in FIG. 1. The secondary-transfer-voltage adjustment process in FIG. 15 is similar to the secondary-transfer-voltage adjustment process in FIG. 12, and the subjects of the process in FIG. 15 are the same as that of the process in FIG. 12. Hereinafter, process contents different from the secondary-transfer-voltage adjustment process in FIG. 12 will be described. The secondary-transfer-voltage adjustment process in FIG. 15 is also executed when the user selects a sheet feed button corresponding to a sheet feed cassette subjected to the automatic adjustment from among the sheet-feed-cassette buttons 510 through 517 on the top screen 500 and selects the adjustment button 908 on the sheet-feed-cassette screen 900 displayed on the external display device 113. It should be noted that the secondary-transfer-voltage adjustment process in FIG. 15 assumes that the above-mentioned top-screen-display control process has been already executed.

In the secondary-transfer-voltage adjustment process in FIG. 15, the process in the steps S1201 through S1216 is performed. Next, the sheet management application 453 of the print control apparatus 102 determines which of the coarse adjustment chart or the fine adjustment chart has been printed in the automatic adjustment of the secondary transfer voltage in the step S1207 (step S1501).

Figure 16:
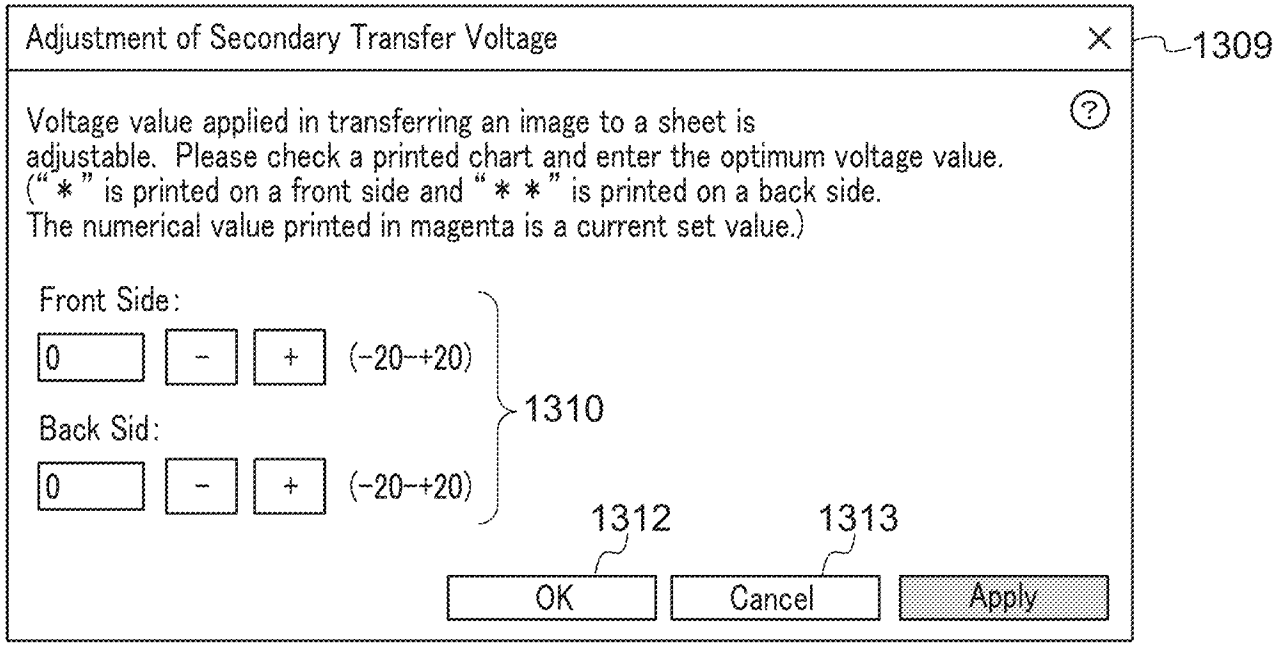
FIG. 16 is a view showing an example of a manual adjustment screen displayed on the external display device in FIG. 4A.

As a result of the determination in the step S1501, when the fine adjustment chart has been printed in the automatic adjustment of the secondary transfer voltage in the step S1207, the sheet management application 453 proceeds with the process to the step S1221 without issuing the chart output instruction. At this time, the sheet management application 453 controls so as not to accept the operation of the chart output instruction from the user who selected the manual adjustment button 1307. For example, the sheet management application 453 controls so as to prohibit the selection of the chart print button 1311 on the manual adjustment screen 1309. Moreover, the sheet management application 453 controls so as not to display the chart print button 1311 on the manual adjustment screen 1309 as shown in FIG. 16.

As a result of the determination in the step S1501, when the coarse adjustment chart has been printed in the automatic adjustment of the secondary transfer voltage in the step S1207, the secondary-transfer-voltage adjustment process proceeds to a step S1502. In the step S1502, the sheet management application 453 instructs the image forming apparatus 103 to output a chart. This chart output instruction includes the "near set voltage value" as the setting in the chart-type setting area 1315 and the setting of the print side in the automatic adjustment as the setting in the print-side setting area 1316. After that, the secondary-transfer-voltage adjustment process proceeds to the step S1219.

In the above-mentioned embodiment, when the fine adjustment chart has been printed in the automatic adjustment of the secondary transfer voltage, the sheet management application 453 controls so as not to accept the operation of the chart output instruction from the user who selected the manual adjustment button 1307. This improves the operability in readjusting the adjusted secondary transfer voltage and prevents print of an unnecessary chart.

Moreover, in the above-mentioned embodiment, even when the fine adjustment chart is printed in the automatic adjustment of the secondary transfer voltage, when a predetermined condition is satisfied, the sheet management application 453 may control so as to accept the operation of the chart output instruction from the user who selected the manual adjustment button 1307. The predetermined condition is satisfied when the user who selected the manual adjustment button 1307 inputs an adjustment value corresponding to a secondary transfer voltage that is not set in print of the fine adjustment chart into the adjustment value input area 1310, for example. When the fine adjustment chart in FIG. 14B is printed during the automatic adjustment of the secondary transfer voltage, the user is able to check the transfer properties of the patches corresponding to the adjustment values "−1" through "9" from the fine adjustment chart. When the user wants to know a transfer property of a patch corresponding to an adjustment value "−2", the user needs operations to input "−2" into the adjustment value input area 1310 and to select the chart print button 1311 to instruct output of a new chart. However, if the sheet management application 453 controls so as not to accept the chart output instruction from the user who selected the manual adjustment button 1307, a new chart cannot be printed and the user cannot check a transfer property of a patch corresponding to a desired adjustment value. Against this, in the above-mentioned embodiment, even when the fine adjustment chart is printed in the automatic adjustment of the secondary transfer voltage, when the above-mentioned predetermined condition is satisfied, the sheet management application 453 controls so as to accept the operation of the chart output instruction from the user who selected the manual adjustment button 1307. This does not obstruct the print of a necessary chart and prevents the damage to the operability.

The client computer 101 may be provided with the software module 451 including the sheet management application 453 in the above-mentioned embodiment. In such a case, the client computer 101 executes the secondary-transfer-voltage adjustment process mentioned above. This improves the operability in readjusting the adjusted secondary transfer voltage by a user from the client computer 101.

Moreover, although the print control apparatus 102 is described as the independent apparatus that is separated from the image forming apparatus 103 in the above-mentioned embodiment, the image forming apparatus 103 may be provided with the functions of the print control apparatus 102. In such a case, the image forming apparatus 103 executes the secondary-transfer-voltage adjustment process mentioned above. This improves the operability in readjusting the adjusted secondary transfer voltage by a user from the operation panel 105.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)'), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-006601, filed Jan. 19, 2021, which is hereby incorporated by reference herein in its entirety.

What is claimed is:

1. A print control apparatus that communicates with an image forming apparatus that has a reading device, the print control apparatus comprising:

at least one processor that causes the print control apparatus to function as:

an instruction unit configured to instruct the image forming apparatus to execute a process that prints a predetermined chart, reads the predetermined chart by the reading device, and sets a secondary transfer voltage;

a reception unit configured to receive an adjustment value obtained by the process from the image forming apparatus; and a display control unit configured to control a display unit to display an object that allows a user to adjust at least the secondary transfer voltage based on reception of the adjustment value obtained by the process by the reception unit, wherein the display control unit controls the display unit to display a chart setting screen on which one of a first chart and a second chart is set as the predetermined chart, the second chart being a chart that allows adjustment of the secondary transfer voltage at a pitch width finer than that of the first chart, and wherein the display control unit controls the display unit to display the chart setting screen in a state where the second chart is set as the predetermined chart, in a case where an operation to instruct display of the chart setting screen is received from a user who selects the object.

2. The print control apparatus according to claim 1, wherein the secondary transfer voltage is a secondary transfer voltage for a sheet onto which the predetermined chart is printed.

3. The print control apparatus according to claim 1, wherein the display control unit controls the display unit to display the adjustment value obtained by the process and the object based on reception of the adjustment value obtained by the process by the reception unit.

4. The print control apparatus according to claim 1, wherein the display control unit controls the display unit to display an initial value, the adjustment value obtained by the process, and the object based on reception of the adjustment value obtained by the process by the reception unit.

5. The print control apparatus according to claim 1, wherein the chart setting screen includes a print-side setting area used to set a print side subjected to adjustment of the secondary transfer voltage, and wherein the display control unit controls the display unit to display the chart setting screen in a state where the print side that is set in the print-side setting area is set in a case where an operation to instruct display of the chart setting screen is received from the user who selects the object.

6. The print control apparatus according to claim 5, wherein the display control unit controls the display unit to display a manual adjustment screen that a user inputs an adjustment value of the secondary transfer voltage, and wherein an instruction to output the predetermined chart from the user who selects the object is accepted in a case where the second chart is printed as the predetermined chart and the user inputs an adjustment value corresponding to a secondary transfer voltage that is not set in print of the second chart to the manual adjustment screen.

7. The print control apparatus according to claim 6, wherein the object comprises an operation button for displaying the manual adjustment screen.

8. The print control apparatus according to claim 1, wherein an instruction to output the predetermined chart from the user who selects the object is not accepted in a case where the second chart is printed as the predetermined chart.

9. A print control apparatus that communicates with an image forming apparatus that has a reading device, the print control apparatus comprising:

at least one processor that causes the print control apparatus to function as:

an instruction unit configured to instruct the image forming apparatus to execute a process that prints a predetermined chart, reads the predetermined chart by the reading device, and sets a secondary transfer voltage;

a reception unit configured to receive an adjustment value obtained by the process from the image forming apparatus; and a display control unit configured to control a display unit to display an object that allows a user to adjust at least the secondary transfer voltage based on reception of the adjustment value obtained by the process by the reception unit, wherein the display control unit controls the display unit to display a chart setting screen on which one of a first chart and a second chart is set as the predetermined chart, the second chart being a chart that allows adjustment of the secondary transfer voltage at a pitch width finer than that of the first chart, and wherein the display control unit controls the display unit not to display the chart setting screen, and the instruction unit instructs the image forming apparatus to print the second chart as the predetermined chart, in a case where an operation to instruct display of the chart setting screen is received from a user who selects the object.

10. A print system comprising:

a display unit;

an image forming apparatus with a reading device; and a print control apparatus that communicates with the image forming apparatus, the print control apparatus comprising:

at least one processor that causes the print control apparatus to function as:

an instruction unit configured to instruct the image forming apparatus to execute a process that prints a predetermined chart, reads the predetermined chart by the reading device, and sets a secondary transfer voltage;

a reception unit configured to receive an adjustment value obtained by the process from the image forming apparatus; and a display control unit configured to control the display unit to display an object that allows a user to adjust at least the secondary transfer voltage based on execution of the process with the execution unit, wherein the display control unit controls the display unit to display a chart setting screen on which one of a first chart and a second chart is set as the predetermined chart, the second chart being a chart that allows adjustment of the secondary transfer voltage at a pitch width finer than that of the first chart, and wherein the display control unit controls the display unit to display the chart setting screen in a state where the second chart is set as the predetermined chart in a case where an operation to instruct display of the chart setting screen is received from a user who selects the object.

11. A control method for a print control apparatus that communicates with an image forming apparatus that has a reading device, the control method comprising:

instructing the image forming apparatus to execute a process that prints a predetermined chart, reads the predetermined chart by the reading device, and sets a secondary transfer voltage;

receiving an adjustment value obtained by the process from the image forming apparatus; and controlling a display unit to display an object that allows a user to adjust at least the secondary transfer voltage based on reception of the adjustment value, wherein the display unit is controlled to display a chart setting screen on which one of a first chart and a second chart is set as the predetermined chart, the second chart being a chart that allows adjustment of the secondary transfer voltage at a pitch width finer than that of the first chart, and wherein the display unit is controlled to display the chart setting screen in a state where the second chart is set as the predetermined chart, in a case where an operation to instruct display of the chart setting screen is received from a user who selects the object.

12. A non-transitory computer-readable storage medium storing a control program causing a computer to execute a control method for a print control apparatus that communicates with an image forming apparatus that has a reading device, the control method comprising:

instructing the image forming apparatus to execute a process that prints a predetermined chart, reads the predetermined chart with the reading device, and sets a secondary transfer voltage;

receiving an adjustment value obtained by the process from the image forming apparatus; and controlling a display unit to display an object that allows a user to adjust at least the secondary transfer voltage based on reception of the adjustment value, wherein the display unit is controlled to display a chart setting screen on which one of a first chart and a second chart is set as the predetermined chart, the second chart being a chart that allows adjustment of the secondary transfer voltage at a pitch width finer than that of the first chart, and wherein the display unit is controlled to display the chart setting screen in a state where the second chart is set as the predetermined chart, in a case where an operation to instruct display of the chart setting screen is received from a user who selects the object.

13. The non-transitory computer-readable storage medium according to claim 12, wherein the secondary transfer voltage is a secondary transfer voltage for a sheet onto which the predetermined chart is printed.

14. The non-transitory computer-readable storage medium according to claim 12, wherein the display unit is controlled to display the adjustment value obtained by the process and the object based on reception of the adjustment value obtained by the process.

15. The non-transitory computer-readable storage medium according to claim 12, wherein the display unit is controlled to display an initial value, the adjustment value obtained by the process, and the object based on reception of the adjustment value obtained by the process.

16. The non-transitory computer-readable storage medium according to claim 12, wherein the chart setting screen includes a print-side setting area used to set a print side subjected to adjustment of the secondary transfer voltage, and wherein the display unit is controlled to display the chart setting screen in a state where the print side that is set in the print-side setting area is set in a case where an operation to instruct display of the chart setting screen is received from the user who selects the object.

17. The non-transitory computer-readable storage medium according to claim 16, wherein the display unit is controlled to display a manual adjustment screen that a user inputs an adjustment value of the secondary transfer voltage, and wherein an instruction to output the predetermined chart from the user who selects the object is accepted in a case where the second chart is printed as the predetermined chart and the user inputs an adjustment value corresponding to a secondary transfer voltage that is not set in print of the second chart to the manual adjustment screen.

18. The non-transitory computer-readable storage medium according to claim 17, wherein the object comprises an operation button for displaying the manual adjustment screen.

19. The non-transitory computer-readable storage medium according to claim 12, wherein an instruction to output the predetermined chart from the user who selects the object is not accepted in a case where the second chart is printed as the predetermined chart.

20. A non-transitory computer-readable storage medium storing a control program causing a computer to execute a control method for a print control apparatus that communicates with an image forming apparatus that has a reading device, the control method comprising:

instructing the image forming apparatus to execute a process that prints a predetermined chart, reads the predetermined chart with the reading device, and sets a secondary transfer voltage;

receiving an adjustment value obtained by the process from the image forming apparatus;

controlling a display unit to display an object that allows a user to adjust at least the secondary transfer voltage based on reception of the adjustment value; and controlling the display unit to display a chart setting screen on which one of a first chart and a second chart is set as the predetermined chart, the second chart being a chart that allows adjustment of the secondary transfer voltage at a pitch width finer than that of the first chart, wherein the display unit is controlled not to display the chart setting screen, and the image forming apparatus is instructed to print the second chart as the predetermined chart, in a case where an operation to instruct display of the chart setting screen is received from the user who selects the object.

* * * * *